US010844630B2

(12) United States Patent
Trupiano

(10) Patent No.: US 10,844,630 B2
(45) **Date of Patent: *Nov. 24, 2020**

(54) PIN TUMBLER LOCK

(71) Applicant: Matthew Trupiano, Roseville, MI (US)

(72) Inventor: Matthew Trupiano, Roseville, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/437,368

(22) Filed: Jun. 11, 2019

(65) Prior Publication Data

US 2020/0056401 A1 Feb. 20, 2020

Related U.S. Application Data

(63) Continuation-in-part of application No. 16/104,985, filed on Aug. 20, 2018.

(51) Int. Cl.
*E05B 27/00* (2006.01)
*E05B 19/00* (2006.01)

(52) U.S. Cl.
CPC ..... *E05B 27/0057* (2013.01); *E05B 19/0017* (2013.01); *E05B 27/0017* (2013.01)

(58) Field of Classification Search
CPC ..... E05B 27/006; E05B 27/0064; E05B 27/0067; E05B 27/0007; E05B 27/0017; E05B 27/0071
USPC ..... 70/352, 386, 419–421
See application file for complete search history.

(56) References Cited

U.S. PATENT DOCUMENTS 1,656,854 A * 1/1928 Best ..... E05B 9/084 24/523
2,059,129 A * 10/1936 Maxwell ..... E05B 15/1614 70/372
2,814,941 A * 12/1957 Best ..... E05B 9/084 70/340
3,045,468 A * 7/1962 Welch ..... E05B 27/006 70/421
3,286,494 A * 11/1966 Sussina ..... E05B 27/0064 70/375
3,298,211 A * 1/1967 Russell ..... E05B 9/084 70/369
3,395,558 A * 8/1968 Russell ..... E05B 27/0053 70/383
3,928,993 A * 12/1975 Epstein ..... E05B 27/00 70/419
4,282,731 A * 8/1981 Taksony ..... E05B 27/0064 70/419
4,328,690 A * 5/1982 Oliver ..... E05B 9/086 70/369
4,377,940 A * 3/1983 Hucknall ..... E05B 15/1614 70/378

(Continued)

FOREIGN PATENT DOCUMENTS

WO WO-9641929 A1 * 12/1996 ..... E05B 27/001

*Primary Examiner* — Suzanne L Barrett
(74) *Attorney, Agent, or Firm* — Raggio & Dinnin, P.C.

(57) ABSTRACT

A pin tumbler cylinder lock that is virtually pick proof comprises a cylinder housing having a single bore and a cylinder key plug arranged in the single bore. The pin tumbler cylinder lock also comprises a cutout having a predetermined shape in a predetermined portion of the housing. The pin tumbler cylinder lock also includes a lockout sleeve arranged over the cylinder key plug wherein the lockout sleeve may rotate within the cutout to create a lockout mode for the pin tumbler cylinder lock when a lock picking attempt is occurring thereon.

18 Claims, 17 Drawing Sheets

(56) References Cited

U.S. PATENT DOCUMENTS

| | | | | | |
|---|---|---|---|---|---|
| 4,386,510 | A * | 6/1983 | Best | E05B 9/084 | 70/369 |
| 4,577,479 | A * | 3/1986 | Widen | E05B 27/006 | 70/378 |
| 4,655,063 | A * | 4/1987 | Foshee | E05B 27/006 | 70/378 |
| 5,507,163 | A * | 4/1996 | Juang | E05B 9/086 | 70/369 |
| 8,739,588 | B2 * | 6/2014 | Burmesch | E05B 27/0017 | 70/378 |
| 10,337,210 | B2 * | 7/2019 | Widen | E05B 27/0003 | |
| 2008/0202181 | A1 * | 8/2008 | Burmesch | E05B 27/0017 | 70/493 |
| 2008/0302150 | A1 * | 12/2008 | Wu | E05B 27/0064 | 70/493 |
| 2015/0240525 | A1 * | 8/2015 | Walls | E05B 27/0053 | 70/344 |
| 2018/0355637 | A1 * | 12/2018 | Widen | E05B 63/0056 | |

* cited by examiner

PIN TUMBLER LOCK

This application is a continuation-in-part of prior U.S. patent application Ser. No. 16/104,985—Filed Aug. 20, 2018

BACKGROUND OF THE INVENTION

1 Field of the Invention

The present invention generally relates to a pin tumbler cylinder lock and more particularly relates to a novel pick proof pin tumbler cylinder lock.

2. Description of Related Art

Pin tumbler locks have been known for many years in the prior art. Generally, a pin tumbler lock uses a key and that key has a set positioning for a plurality of tumblers arranged within the pin tumbler lock and holds those pin tumblers at a shear line arranged at an outer periphery of a cylinder key plug, thus allowing for the key and similar key plug to turn within the cylinder housing of the pin tumbler lock. This in turn may turn a cam or other device connected to the end of the cylinder key plug thus unlocking the door or other device being locked by the prior art pin tumbler lock. Similar locks are found on most if not all devices, such as doors, closets, safe boxes or any other device that uses a key lock therein. Generally, traditional pin tumbler locks may be pickable because rotational tension may be applied to the cylinder plug thereby permitting tumblers to be held in proper order when manipulating them so as to duplicate the permutation or combination of the pin tumblers of a correct key. Many of these prior art pin tumbler locks are capable of being picked by lock picking tools and instructions which are found in magazines, television, websites, YouTube, etc. Furthermore, the prior art also includes ready made lock picking tool sets or methods which are used to fabricate manual pick locking.

In view of these prior art methods of picking pin tumbler locks there is a need in the art for a simple and inexpensive lock mechanism that is virtually pick proof and is adaptable for general use. There also is a need in the art for a pin tumbler lock mechanism arranged within a conventional pin tumbler cylinder lock which may allow for a virtually pick proof lock, i.e., an anti-pick pin tumbler cylinder lock.

The prior art includes some high security cylinder locks that generally are virtually pick proof, but their cost and complexity prohibit their general use in the public. There is a need in the art for a simple and inexpensive cylinder lock that is virtually pick proof, thus satisfying the need for general use. Furthermore, many of these prior art security electronic key pad sets require a mechanical key override and the present invention would fulfill a need for an inexpensive and secure pin tumbler lock that may equally exceed the best known key pad security. Generally, there also is a need in the art for a lock that may also function as a conventional pin tumbler lock type but renders the cylinder lock virtually pick proof due to the internal mechanism arranged therein that eliminates proper binding tension on pin tumblers which is a pre-condition for picking locks. There also is a need in the art for a low cost, easy to use and effective cylinder lock that is capable of being virtually pick proof while also capable of being retroactively placed into existing cylinder locks or easily manufactured into future cylinder locks. There also is a need in the art for an improved pin tumbler cylinder lock that uses a combination of a cylinder lock out sleeve and a plurality of ball bearings to create a virtually pick proof lock.

SUMMARY OF THE INVENTION

One object of the present invention may be to provide a novel and unique pin tumbler cylinder lock.

Another object of the present invention may be to provide a novel pin tumbler cylinder lock that may function as a conventional pin tumbler lock while also being virtually pick proof thereby achieving greater security with a minimum cost.

Yet another object of the present invention may be to provide a pin tumbler cylinder lock that is adaptable for padlocks, door locks, vending machines, safes and wherever higher security pin tumbler locks may be required or in any other lock situation.

Still another object of the present invention may be to provide a pin tumbler cylinder lock that may be used in conjunction with electronic key pad sets that require mechanical key override to allow for an inexpensive and secure pin tumbler lock that would equal or exceed the key pad security thereof.

Still a further object of the present invention may be to provide a pin tumbler cylinder lock that is unable to be unlocked with any prior art lock picking device or tool and is pick proof even to one skilled in the art of locking picking.

Yet a further object of the present invention may be that it provides a pin tumbler cylinder lock that may be mastered keyed and may not interact with novel pick resistant mechanisms arranged within the cylinder lock.

Yet a further object of the present invention may be that it provides a pin tumbler cylinder lock that is capable of utilizing all possible permutations or key combinations irrespective of a novel pick resistant mechanism arranged within the cylinder lock.

According to the present invention, the foregoing and other objects and advantages are obtained for a novel design of a pin tumbler cylinder lock. The pin tumbler cylinder lock generally may be able to thwart any attempt that is made to pick the pin tumbler cylinder lock by turning the tension that is applied to the cylinder key plug, i.e., the rotational tension, such that the tension may only bind on tumblers in two of the six pin chambers within the pin tumbler cylinder lock. Furthermore, the tumblers in the two selected pin chambers must be picked before key plug rotation may be utilized to bind tumblers in the remaining four pin chambers. However, any rotational tension on the middle four tumblers is not allowable due to the use of a lock out sleeve and ball bearing arrangement which prohibits the rotational tension essential for lock picking. Therefore, the present pin tumbler cylinder lock only permits the lock out sleeve and the cylinder key plug to rotate together into a cavity of the cylinder housing wherein the cavity of the cylinder housing becomes a lock out chamber. Hence, the pin tumbler cylinder lock of the present invention may be set into a lock out mode thereby neutralizing any picking of the pin tumbler cylinder lock. It should be noted that normal pin tumbler cylinder lock function may be restored by reversing rotation of the cylinder key plug to the neutral position or lock mode.

One advantage of the present invention may be that it provides a novel and unique pin tumbler cylinder lock.

Another advantage of the present invention may be that it provides a pin tumbler cylinder lock that may function as a conventional pin tumbler lock with the advantage of being virtually pick proof thereby achieving greater security with a minimum cost.

Yet another advantage of the present invention may be that it provides a pin tumbler cylinder lock that may virtually replace any conventional pin tumbler cylinder lock of the prior art and is adaptable for padlocks, door locks, vending machines, safes, and wherever higher security pin tumbler locks may be required and in any other known locking situation or environment.

Still another advantage of the present invention may be that it provides a pin tumbler cylinder lock that is capable of being used in conjunction with a secure electronic lock set that requires a mechanical key override, therefore creating an inexpensive and secure pin tumbler lock assembly that may equal or exceed the security of the key padlock set.

Still another advantage of the present invention may be to provide a pin tumbler cylinder lock that cannot be unlocked with prior art lock picking device tools and is even pick proof by one skilled in the art of lock picking.

Still another advantage of the present invention may be to provide a pin tumbler cylinder lock that may be mastered keyed and may not interact with novel pick resistant mechanisms arranged within the cylinder lock.

Still another advantage of the present invention may be to provide a pin tumbler cylinder lock that is capable of utilizing all possible permutations or key combinations irrespective of pick resistant mechanisms arranged within the cylinder lock.

Still another advantage of the present invention may be to provide a pin tumbler cylinder lock that uses a lockout sleeve in combination with a ball bearing arrangement to create a virtual pick proof lock.

Still another advantage of the present invention may be to provide a pin tumbler cylinder lock that is low cost, easy to manufacture and is capable of being retro fitted into existing locks and easily manufactured into new locks.

Other objects, features and advantages of the present invention may become apparent from the subsequent description and appended claims taken in conjunction with the accompanying drawings.

BRIEF DESCRIPTION OF THE DRAWING(S)

DESCRIPTION OF THE EMBODIMENT(S)

Figure 1:
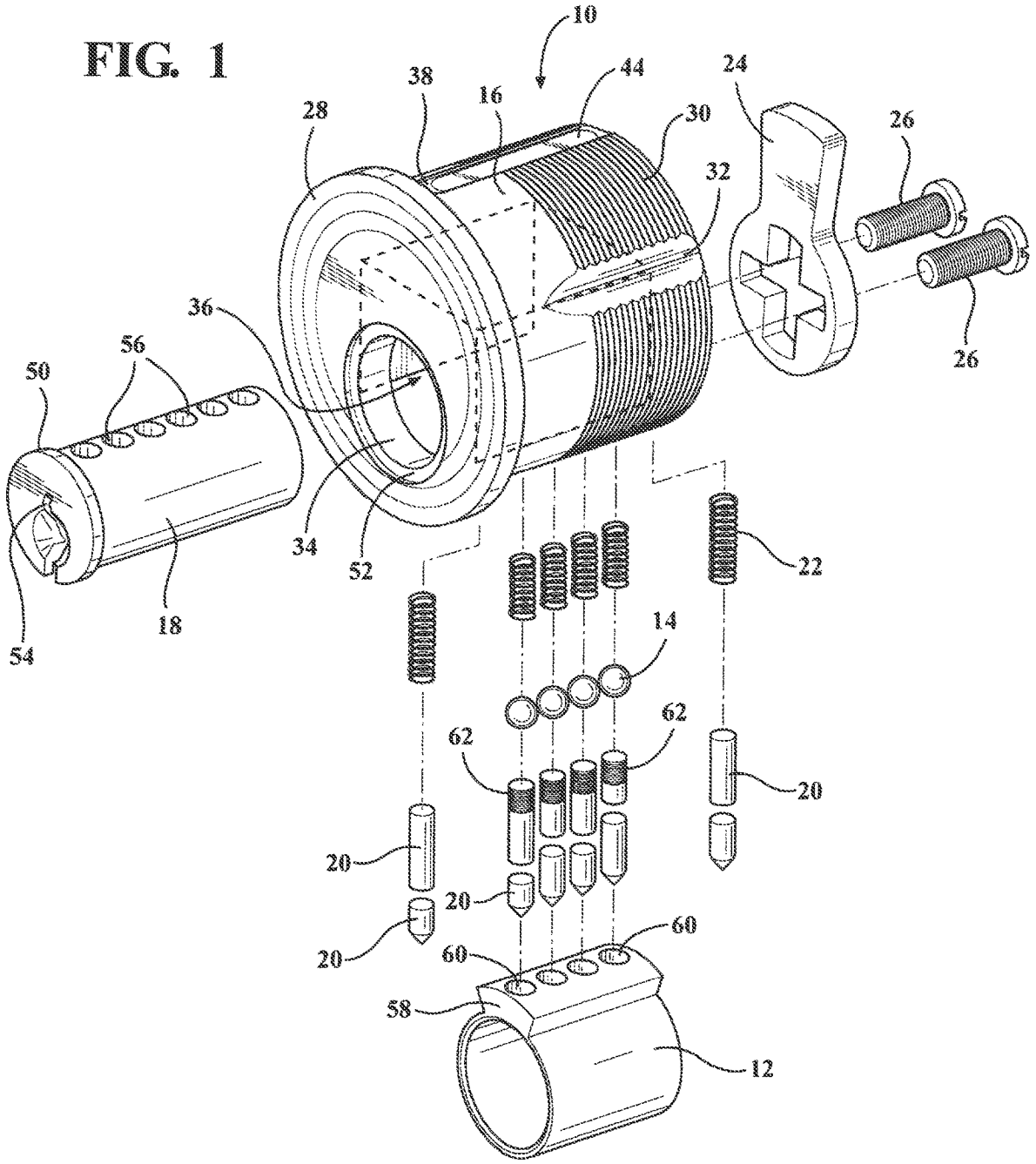
FIG. 1 shows an exploded view of a pin tumbler cylinder lock according to the present invention.
Figure 2:
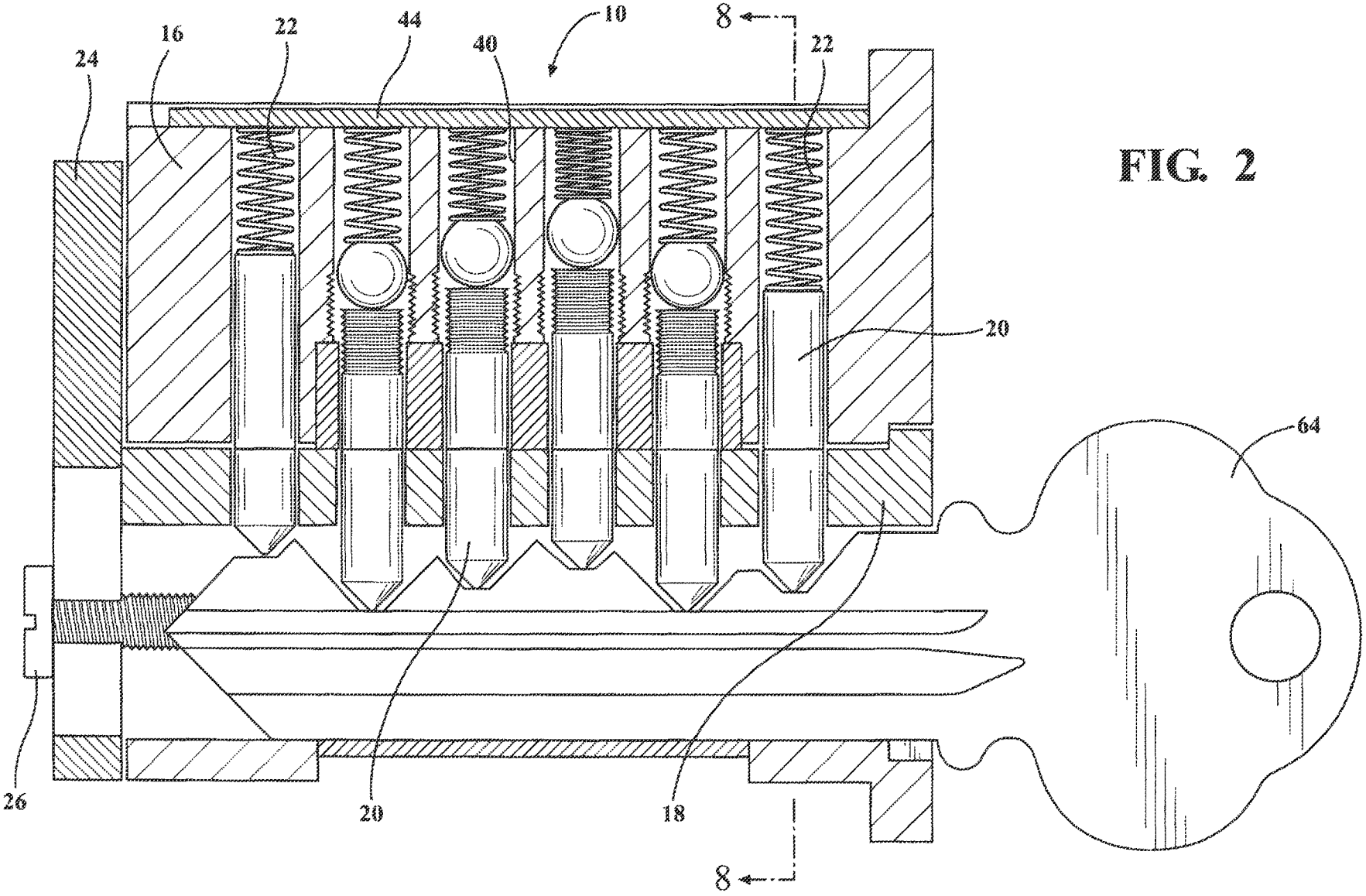
FIG. 2 shows a partial cross sectional view of a pin tumbler cylinder lock in the neutral or unlocked position according to the present invention.
Figure 3:
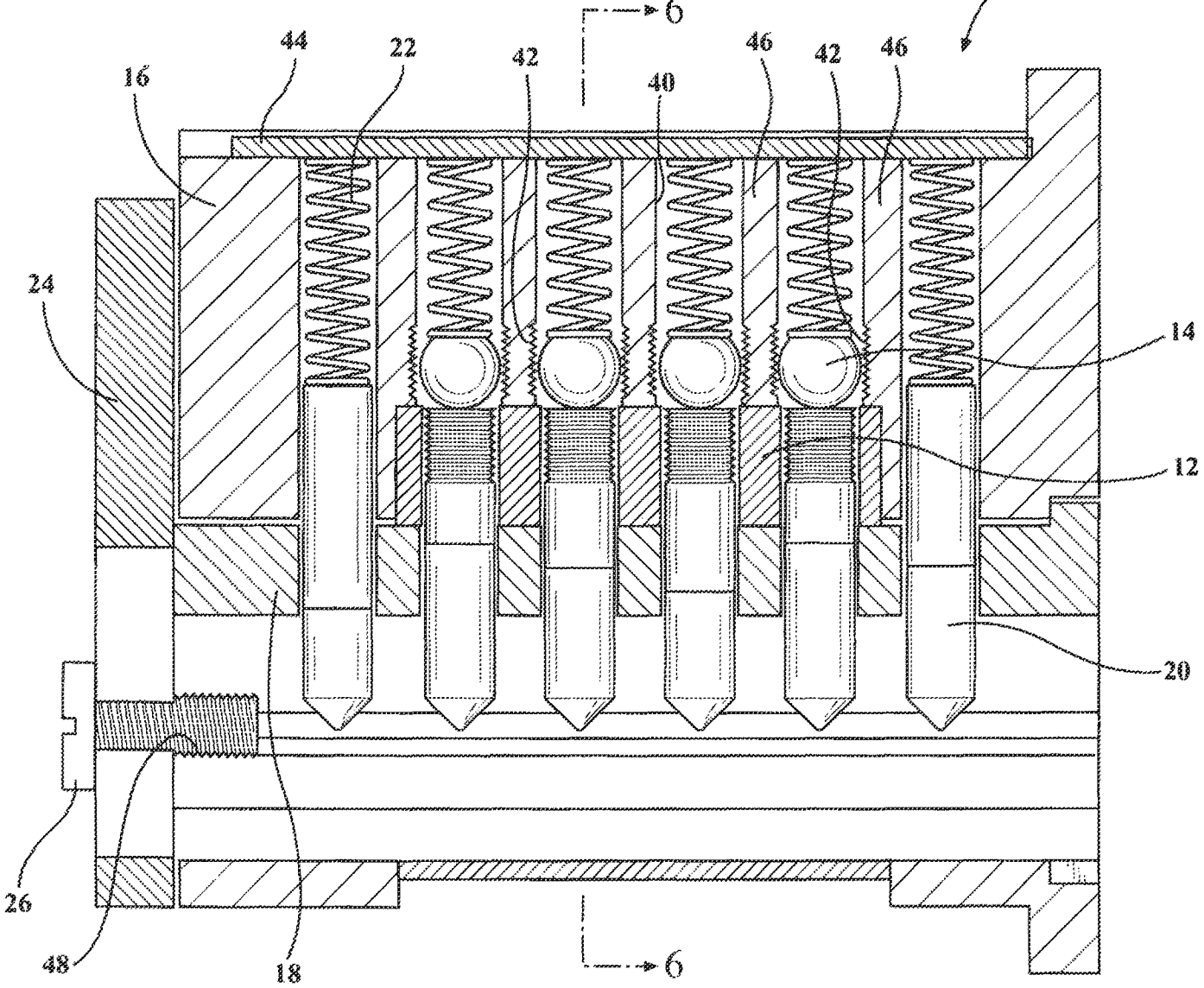
FIG. 3 shows a partial cross sectional view of a pin tumbler cylinder lock in a locked position according to the present invention.
Figure 4:
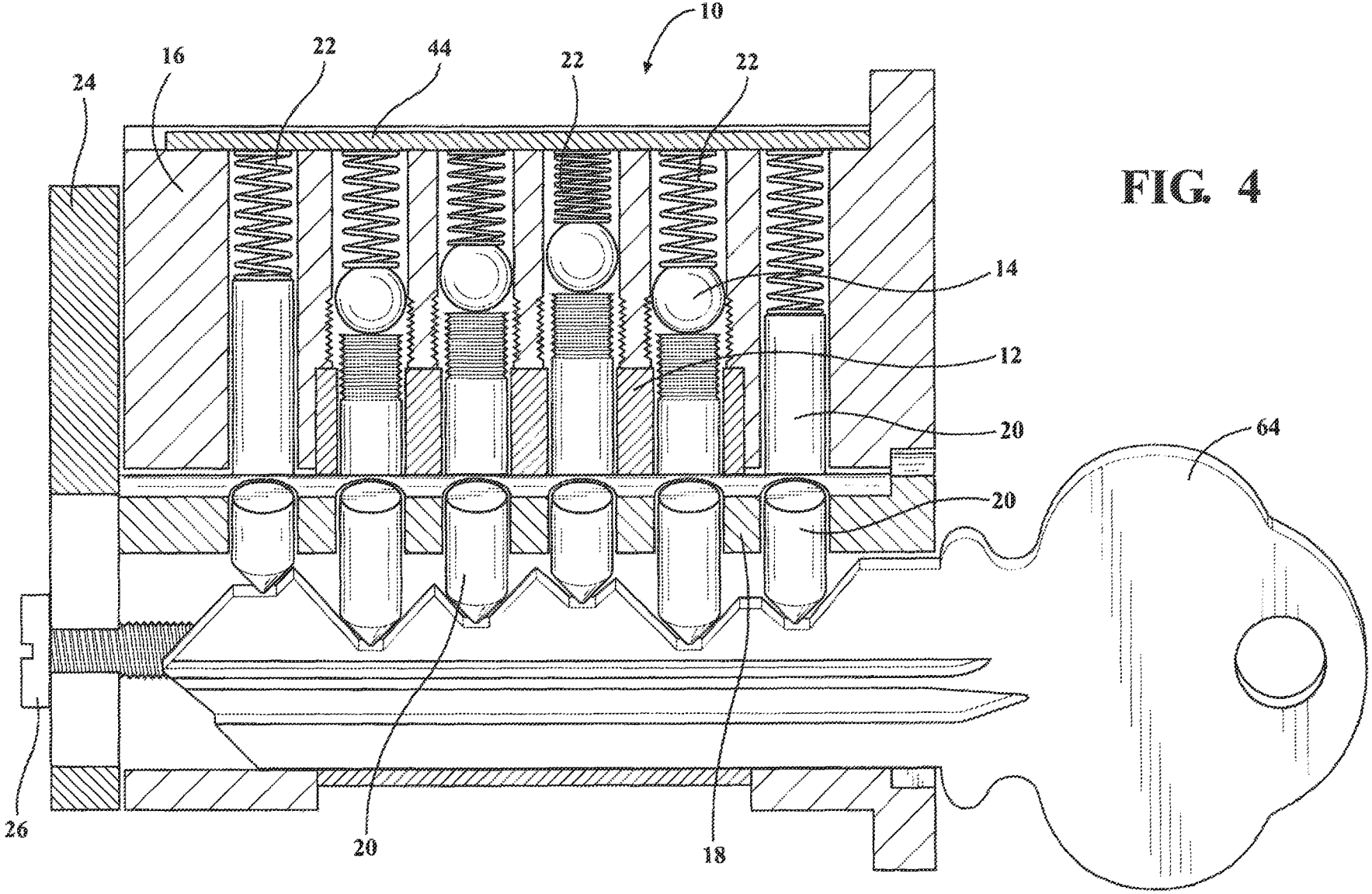
FIG. 4 shows a partial cross sectional view of a pin tumbler cylinder lock in an unlocked position according to the present invention.
Figure 5:
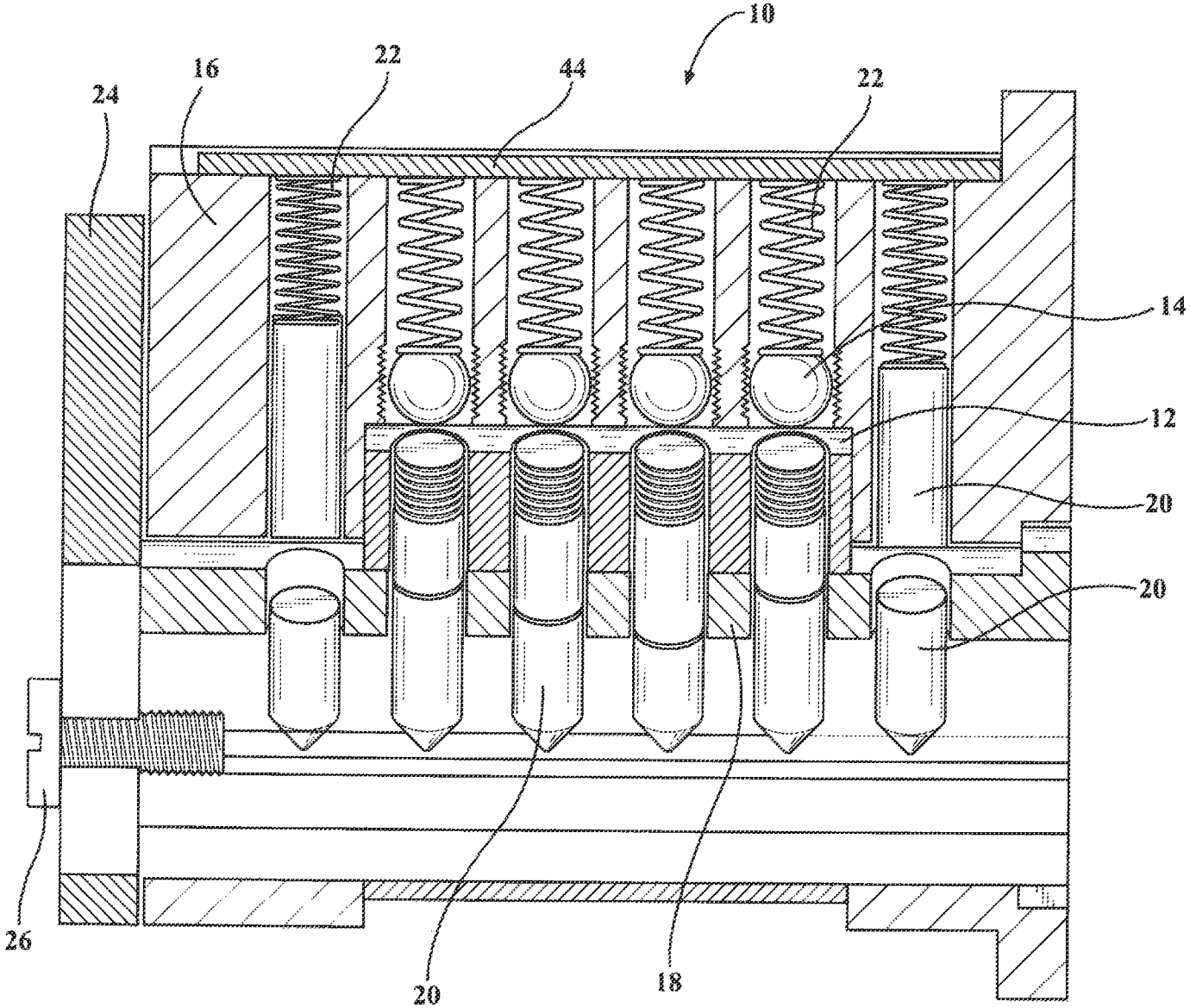
FIG. 5 shows a partial cross sectional view of a pin tumbler cylinder lock in lock out mode according to the present invention.
Figure 6:
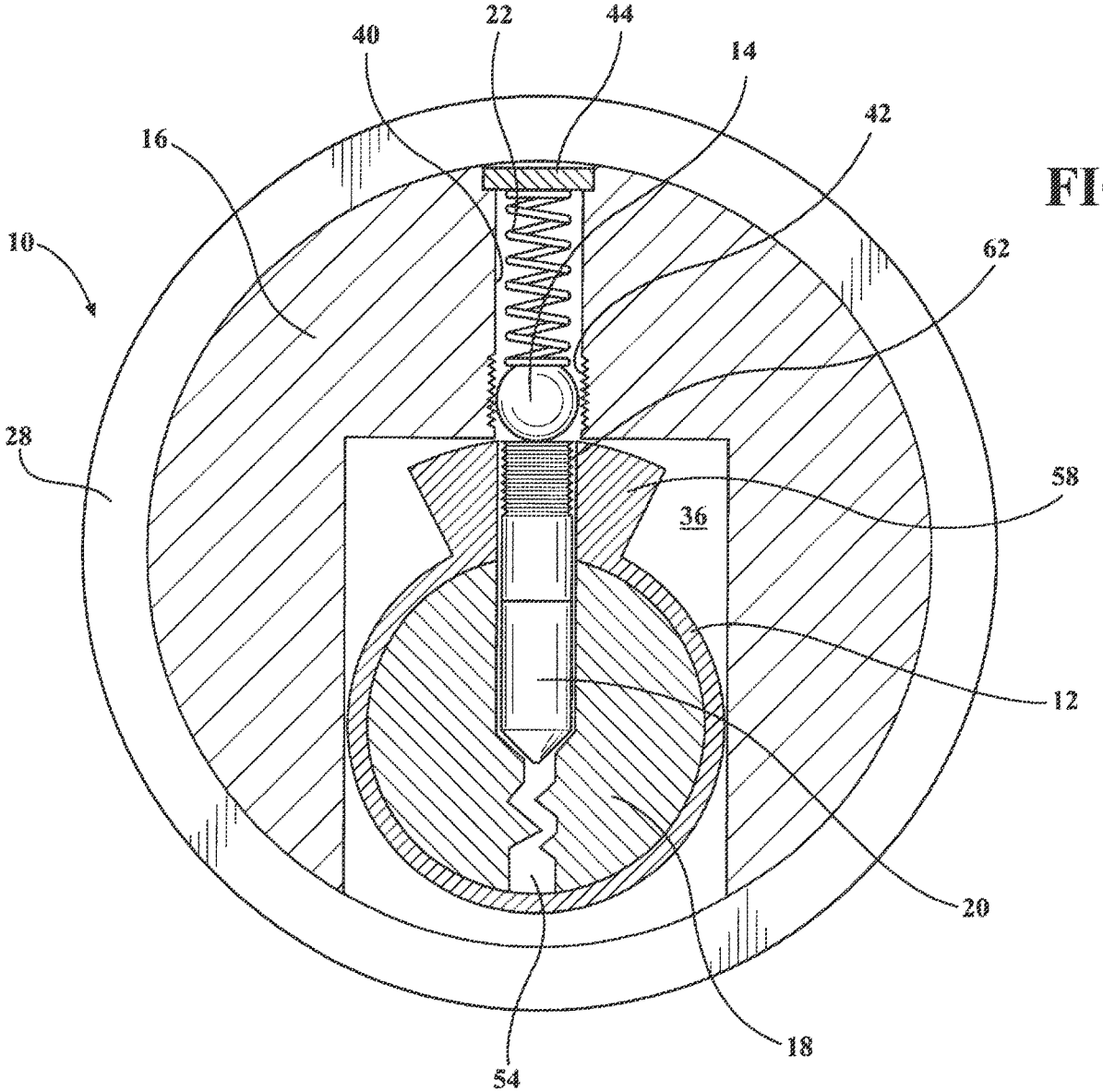
FIG. 6 shows a partial cross sectional view of the pin tumbler cylinder lock taken along line 6-6 of FIG. 3 according to the present invention.
Figure 7:
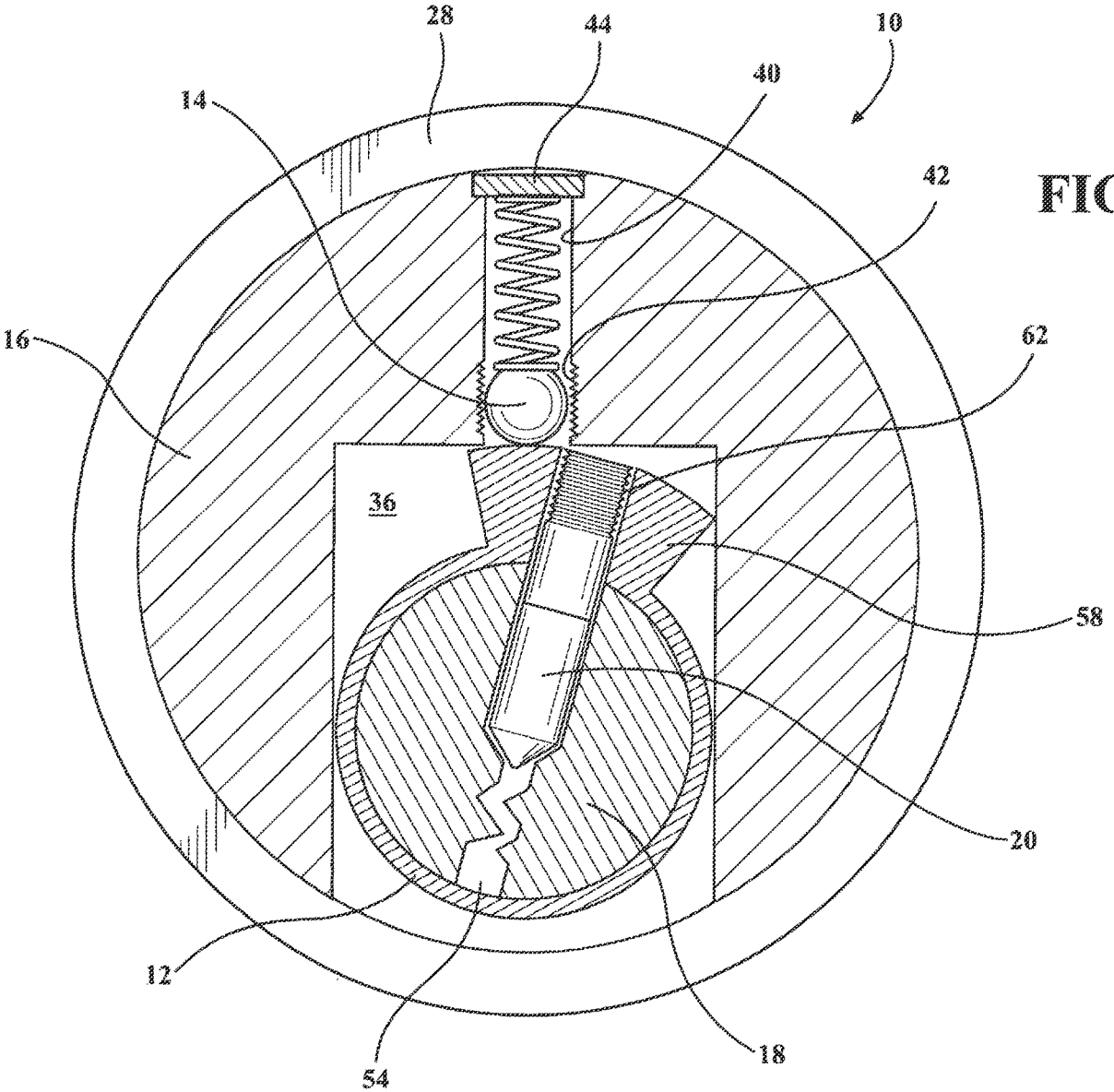
FIG. 7 shows a partial cross sectional view of the pin tumbler cylinder lock in lockout mode according to the present invention.
Figure 8:
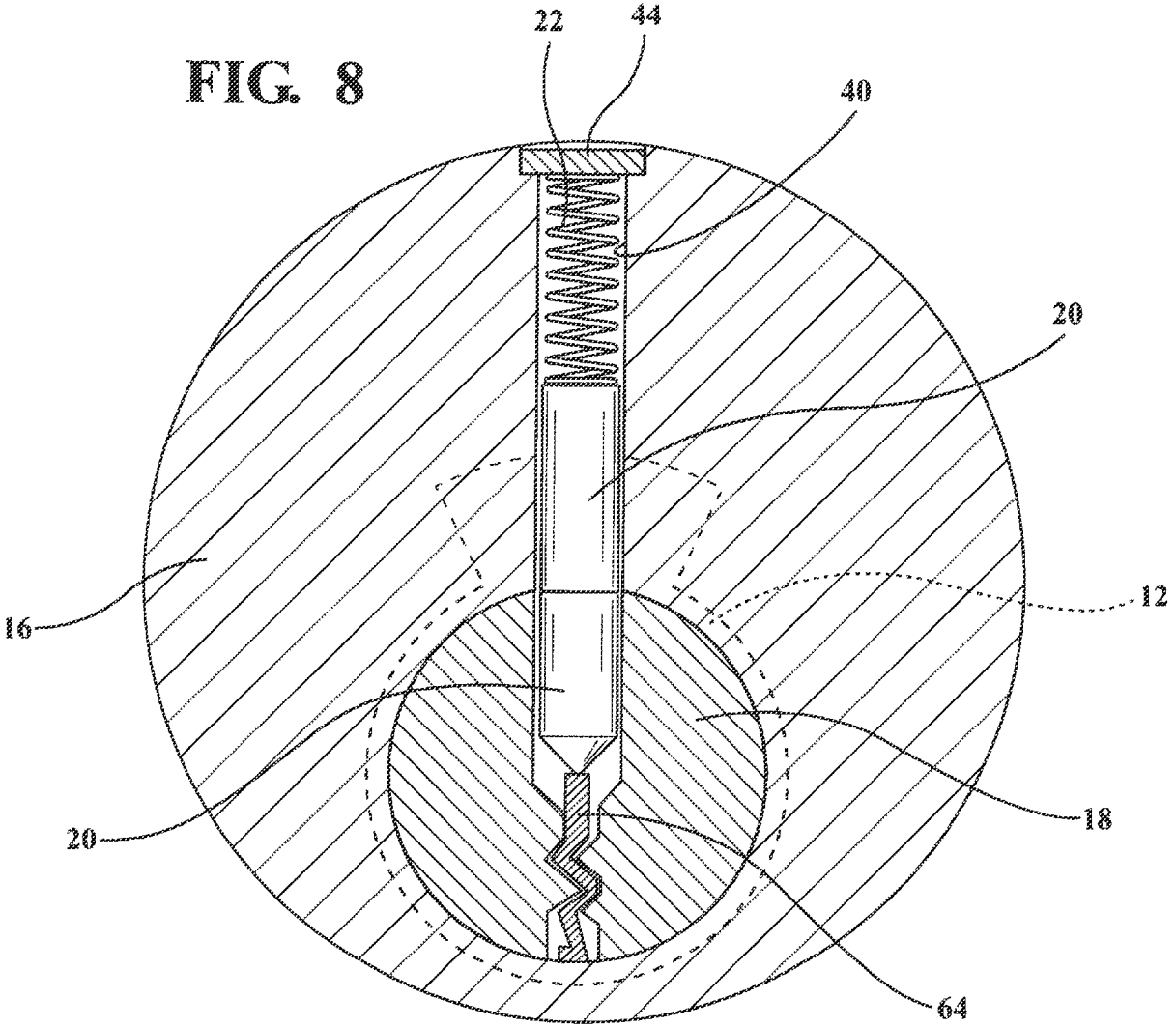
FIG. 8 shows a partial cross sectional view of a pin tumbler cylinder lock taken along line 8-8 of FIG. 2 according to the present invention.
Figure 9:
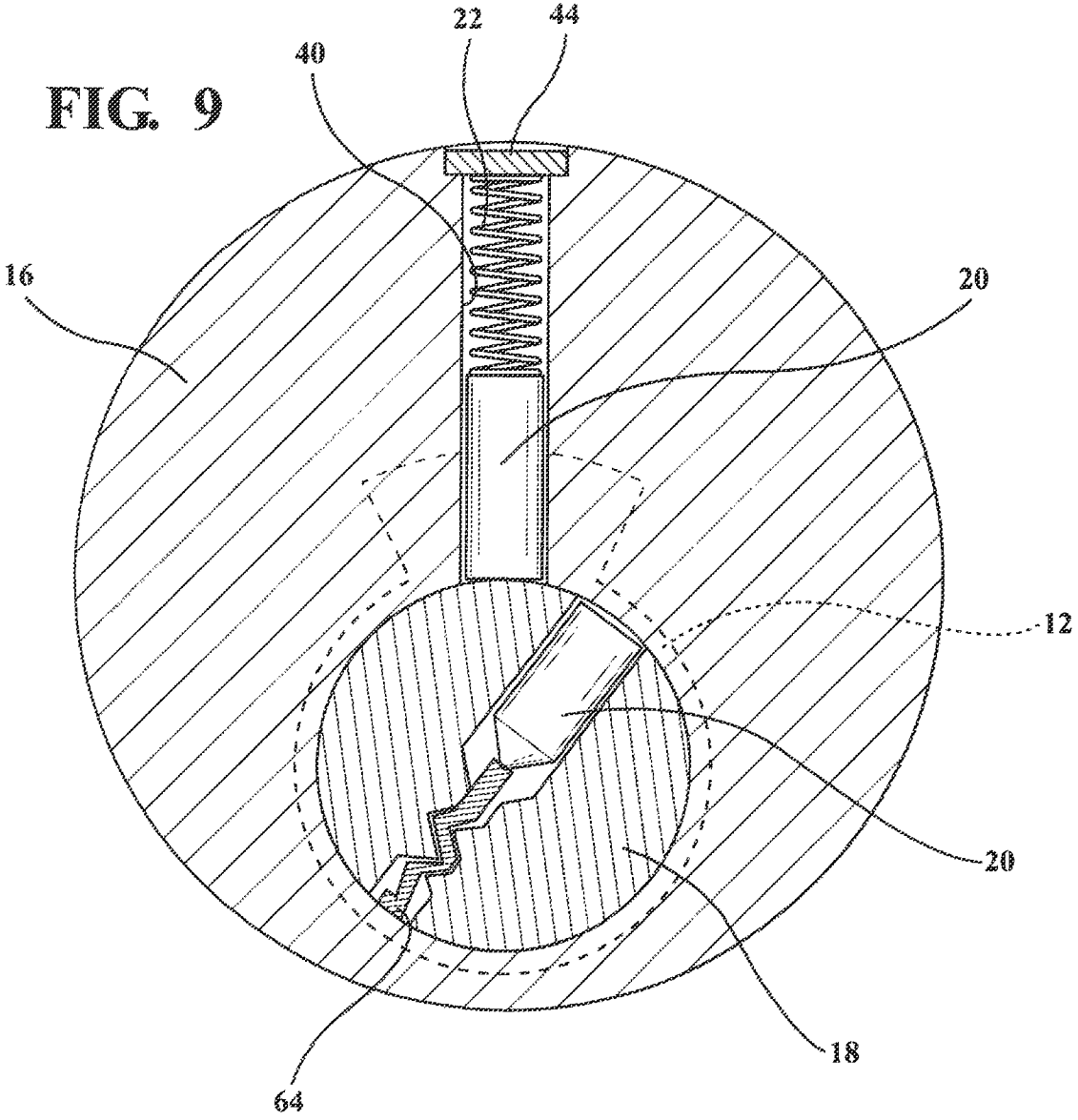
FIG. 9 shows a partial cross sectional view of a pin tumbler cylinder lock in an unlocked position according to the present invention.

Referring to the drawings, a pin tumbler cylinder lock 10 according to the present invention is shown. It should be noted that the pin tumbler cylinder lock 10 of the present invention is capable of being used both indoors and outdoors. It should further be noted that the pin tumbler cylinder lock 10 is capable of use in any known locking situation or environment, such as but not limited to padlocks, door locks, vending machines, safes and wherever high security pin tumbler locks are required or in any other known locking situation depending upon the design requirements. The pin tumbler cylinder lock 10 of the present invention generally is a practical pin tumbler cylinder lock that is virtually pick proof through the introduction of novel mechanisms arranged within the pin tumbler cylinder lock 10. In one case, a lockout sleeve 12 and ball bearing 14 arrangement are arranged therein thus allowing for a pick proof lock that is not capable of being picked by prior art picking mechanisms and by persons skilled in the art of lock picking. The pin tumbler cylinder lock 10 may function as a conventional pin tumbler lock mechanism, but may also render the pin tumbler cylinder lock 10 virtually pick proof through the use of a lock out sleeve 12 and ball bearing 14 arrangement arranged within the internal mechanisms of the pin tumbler cylinder lock 10. The use of the lock out sleeve 12 and ball bearings 14 may eliminate any proper binding tension that is necessary on pin tumblers for lock picking to occur. With the elimination of the binding tension, which is a precondition for picking locks, it makes the pin tumbler cylinder lock 10 of the present invention virtually pick proof. Generally, the pin tumbler cylinder lock 10 of the present invention may include a cylinder housing or cylinder lock housing 16, a cylinder key plug 18, a lockout sleeve 12, a plurality of tumblers 20, a plurality of springs 22, a plurality of ball bearings 14, and a cam 24 and necessary fasteners 26 to secure the cam 24 to the cylinder key plug 18. It should be noted that the cam 24 may be used to operate a bolt, a latch or any other locking mechanism associated with the pin tumbler cylinder lock 10. Therefore, any known pin tumbler cylinder lock in existence may be retro fitted with minor changes into the pick proof pin tumbler cylinder lock 10 of the present invention or any new pin tumbler cylinder lock 10 may be manufactured having the lock out sleeve 12 and ball bearing 14 arrangement placed directly therein.

The pin tumbler cylinder lock 10 of the present invention generally is shown in the Figures. The pin tumbler cylinder lock 10 includes a cylinder lock housing 16. The cylinder lock housing 16 generally has a cylindrical shape of any known dimension and it may include a circumferential flange 28 arranged on one end thereof. It should be noted that the cylinder housing 16 generally is made of a brass or iron material, however any other type of metal, ceramic, plastic, composite, or natural material may also be used to create the cylinder housing 16 of the present invention and all of the other components of the present invention. The cylinder housing 16 may also include a plurality of threads 30 arranged on an outer surface thereof. The threads 30 may extend a predetermined distance from the end of the cylinder housing 16 opposite the end with the circumferential flange 28. The cylinder housing 16 may also include at least one notch 32 arranged on an outer surface thereof, however it is also contemplated to create the cylinder housing 16 without any notches 32 or threads 30 arranged thereon. In the present embodiment, the notches 32 generally may have a triangular shape when viewed in cross section. It should further be noted that the cylinder housing 16 also may include a circular bore or circular inner bore 34 extending the entire length thereof. The circular inner bore 34 generally may have a predetermined diameter and may be arranged at or near a bottom surface of the cylinder housing 16. It should be noted that any other shape bore may be used other than the circular cylindrical inner bore, however the bore must be capable of allowing rotation therein to allow for the locking and unlocking of the pin tumbler cylinder lock 16 of the present invention. Therefore, in the preferred embodiment the single inner bore 34 has a circular or cylindrical shape and extends through the entire length of the cylinder housing 16. It should be noted that the inner bore may be located in any other position other than near the bottom of the cylinder housing 16 as shown in the drawings. The cylinder housing 16 of the present invention also may include a cavity or lock out cavity 36 arranged in an outer surface thereof. In the embodiment shown, the cavity 36 is arranged in the bottom surface of the cylinder housing 16 adjacent to the single inner bore 34 arranged through the length of the cylinder housing 16. It should be noted that the cavity 36 may have any known shape, however in one contemplated embodiment the cavity 36 may have a square or rectangular shape that extends a predetermined distance into the cylinder housing 16. It should be noted that the cylinder housing 16 is generally solid, however it is also contemplated to use a hollow cylinder to create the cylinder housing 16. It should be noted that the cavity 36 in the cylinder housing 16 may extend any known distance within the housing but generally may extend more than half way through the housing depending on the design requirements. It should further be noted that it may not extend even half way into the housing depending on the size of the cylinder key plug 18 arranged therein. The cavity 36 may include, but does not have to include, a plurality of circular areas arranged at each corner of the cylindrical cavity in one embodiment, however it is also contemplated to create the cavity 36 without having any type of cylindrical shaped area arranged at the corners of the generally square or rectangular cavity 36. It should be noted that the cavity 36 may be of any other shape other than square or rectangular depending on the design requirements of the pin tumbler cylinder lock 10. The cavity 36 may be arranged a predetermined distance from the front face and the back face of the cylinder housing 16. It may also be arranged a predetermined distance from each outer edge of the outer diameter of the cylinder housing 16 according to the present invention. It should be noted that any known size from a sixty fourth of an inch too many feet may be used for any of the dimensions of the pin tumbler cylinder lock 10 according to the present invention. It should be noted that the cavity 36 may be formed during manufacturing of the cylinder housing 16 or may be retro actively inserted into the bottom surface of an existing cylinder housing via any known manufacturing technique, such as drilling, sawing, routering, laser cutting or any other known mechanical or chemical technique for creating a cavity into a surface of a solid metal or other material. Therefore, the cavity 36 of the cylinder housing 16 may have a predetermined length and a predetermined width, which may be determined based on the environment and size of the pin tumbler cylinder lock 10. The cylinder housing 16 may also include a generally rectangular shaped channel 38 arranged along a top surface of the cylinder housing 16. The channel 38 may be directly opposite the midpoint of the cavity 36 arranged in the bottom surface of the cylinder housing 16. The channel 38 may have a predetermined depth into the outer surface of the cylinder housing 16. It should be noted that any known depth may be used for the channel 38 and any other known shape may be used for the channel other than rectangular as shown in the drawings.

Arranged within the channel 38 may be a plurality of orifices or pin chambers 40 that extend a predetermined distance into the cylinder housing 16. Generally, in one contemplated embodiment, there may be a total of six circular orifices 40 arranged within the top channel of the cylinder housing 16. Generally, these orifices 40 may be arranged between the top outer surface of the cylinder housing 16 and either the inner bore 34 of the cylinder housing 16 or the cavity 36 of the cylinder housing 16 depending on the location of the orifices 40. The orifices 40 are commonly referred to as pin chambers 40. Hence, it should be noted that the plurality of pin chambers 40 in one preferred embodiment may be a total of six pin chambers 40 with the first and last pin chamber 40 being arranged between an outer surface of the cylinder housing 16 and the inner bore 34 of the cylinder housing 16 while the middle pin chambers 40 may be arranged between an outer surface of the cylinder housing 16 and the cavity 36 on the opposite end thereof. The pin chambers 40 may have a predetermined diameter wherein the diameter of the middle four pin chambers 40 may be slightly larger or bigger than the diameter of the outer two pin chambers 40. It should be noted that any known diameters from a sixty fourth of an inch to multiple inches may be used for the diameters of the pin chambers 40 according to the present invention. The first and last two or end pin chambers 40 may have a smooth inner bore the entire length thereof. The middle four pin chambers 40 may include a serrated or threaded lower 42 portion therein. In one contemplated embodiment, the threaded or serrated lower portion 42 of the four middle pin chambers 40 may extend a predetermined distance that generally may be equal to or slightly longer or shorter than the diameter of a ball bearing 14 arranged therein. It should be noted that it is also contemplated to use the four middle pin chambers 40 without the serrated lower portion 42 arranged therein and it is also contemplated to have the serrated portion extend the entire length or any other length of the middle four pin chambers 40 or even on the two end pin chambers 40. As noted above, the middle four pin chambers 40 may have a diameter that is larger than the two end pin chambers 40. The walls 46 between and at the ends of the pin chambers 40 may have different thicknesses, depending upon the design requirements and the environment in which the pin tumbler cylinder lock 10 may be used. It should be noted that the inner walls or a portion of the inner walls of the first and last pin chamber 40 and the two end walls of the lock out sleeve flange 58 are half sized walls in comparison to the middle walls thereof. The cylinder housing 16 may also include a spring cap 44 arranged within and secured within the channel 38 arranged on the top surface of the cylinder housing 16. The spring cap 44 may be made of any known metal or any other known material and may used to secure the springs 22 and ball bearings 14 within the pin chambers 40 of the cylinder housing 16. It should be noted that it is also contemplated to use any other known shape for the cavity 36 such as an arcuate shape that is arranged over a predetermined top portion of the inner bore 34 of the cylinder housing 16.

The pin tumbler cylinder lock 16 of the present invention also may include a cylinder key plug 18. The cylinder key plug 18 generally may have a cylindrical shape that is generally the same length or slightly smaller or longer than that of the cylinder housing 16. Arranged in one end of the cylinder key plug 18 may be a first and second orifice 48. Generally, these orifices 48 are circular in shape and may have threads arranged on an inside surface thereof. The threads are used to receive a fastener 26, such as a screw or any other type of fastener within the two end orifices 48 of the cylinder key plug 18 to allow for connection of a cam 24 or other locking device directly to the outer surface of the cylinder key plug 18. It should be noted that the cylinder key plug 18 generally may have a length that is slightly larger than the length of the cylinder housing 16 thus allowing for a cam 24 to be securely fastened to the outer end of the cylinder key plug 18 while also allowing for rotation with respect to the end of the cylinder housing 16. However, any other length cylinder key plug 18 including one that is slightly shorter, the same length, or much longer than the cylinder housing 16 may also be used. The cylinder key plug 18 on one end thereof may have a circumferential flange 50 extending around the outer periphery thereof. The circumferential flange 50 generally may mate with and inter engage with a circumferential cavity 52 arranged in a front face of the cylinder housing 16, wherein the circumferential cavity 52 forms a circumferential riding surface or shoulder that interacts with the circumferential flange 50 of the cylinder key plug 18 to allow for the cylinder key plug 18 to rotate within the cylinder housing 16 such that the front face of the cylinder housing 16 and the cylinder key plug 18 align with one another to create an aesthetically pleasing front flat face for the pin tumbler cylinder lock 10. The cylinder key plug 18 also may include a paracentric key way 54 arranged along an entire or partial length thereof. The paracentric key way 54 may obstruct easy accessibility to the tumblers 20 arranged within the pin tumbler cylinder lock 10 thus leading to an impediment for lock picking. It should be noted that any other type of key way may also be used in the cylinder key plug 18 of the present invention. It should be noted that the cylinder key plug 18 may have an outer diameter that is slightly less than the inner diameter of the inner bore 34 of the cylinder housing 16, thus allowing for free rotation between the cylinder housing 16 and the cylinder key plug 18. It is also contemplated to put a plurality of bearings or other rotational aids between the inner bore 34 of the cylinder housing 16 and the outer surface of the cylinder key plug 18. The cylinder key plug 18 also may include a plurality of circular orifices or pin chambers 56 arranged in a top surface thereof. The circular orifices 56 may extend from the outer surface of the cylinder key plug 18 into the key way 54 of the cylinder key plug 18. These circular orifices 56 may have a predetermined diameter that may generally match or be equal to the diameter of the two end pin chambers 40 of the cylinder housing 16. All of the orifices 56 through the top surface of the cylinder key plug 18 may have the same diameter.

The pin tumbler cylinder lock 10 of the present invention may also include a lockout sleeve 12. Generally, the lockout sleeve 12 has a hollow cylindrical shape. The lock out sleeve 12 may generally have a circular inner diameter that is generally slightly larger than or the same as the outer diameter of the cylinder key plug 18. The lockout sleeve 12 may have a predetermined thickness for its cylindrical wall. Arranged at a top portion of the lockout sleeve 12 may be an arcuate or any other shaped flange 58. The arcuate flange 58 may generally have a circular shape and extend in a predetermined arc along the upper surface of the lockout sleeve 12. It should be noted that the flange 58 may extend a predetermined distance from the top surface of the lockout sleeve 12 and extend a predetermined radial distance from the top point of the lockout sleeve 12 in both directions. It should be noted that any other shape may be used for the flange 58 other than an arcuate shape as shown in the drawings. The lockout sleeve 12 may have a predetermined length. Generally, the length may be less than the overall length of the cylinder key plug 18 and the length may generally be equal to or slightly less than the length of the cavity 36 arranged in the cylinder housing 16. This may allow the lockout sleeve 12 to be able to rotate with respect to the cylinder housing 16 within the cavity 36 arranged. The outer diameter of the lockout sleeve 12 generally may be equal to or slightly less than the width of the cavity 36 of the cylinder housing 16, thus allowing for rotational movement to occur by the lockout sleeve 12 and cylinder key plug 18 within the cavity or lockout chamber 36 of the pin tumbler cylinder lock 10 according to the present invention. The lockout sleeve 12 may also include a plurality of orifices or pin chambers 60 arranged through the flange 58 thereof. The orifices 60 may extend between the top surface of the flange 58 and an inner bore of the lockout sleeve 12. It should be noted that the orifices 60 generally may have the same diameter as the orifices 56 of the cylinder key plug 18 and the two end pin chambers 40 of the cylinder housing 16. Thus, the four middle pin chambers 40 along with the four orifices 60 through the lockout sleeve 12 and the orifices 56 through the top of the cylinder key plug 18 may form some or all of the entire pin chambers for the locking mechanism. The lock out sleeve 12 may have different sized walls arranged between the four orifices 60 then the end walls thereof. In one contemplated embodiment, an end wall may be half the size of a wall between two of the orifices 60. The lockout sleeve 12 may allow for a virtually pick proof lock by allowing for slight rotation of the cylinder key plug 18 in a left or right direction into a lock out mode thus keeping the lock 10 from being picked by any commercially available picking product or by a professional manual lock picker.

The pin tumbler cylinder lock 10 of the present invention also includes a plurality of two piece pin tumblers 20 arranged in the six pin chambers 40 of the pin tumbler cylinder lock 10. Generally, it should be noted that the pin tumblers 20 are broken or split into a top tumbler and a bottom tumbler wherein the top tumblers and bottom tumblers generally have different lengths or heights. The dissimilar heights on the bottom pin tumblers may designate the size of the correlated top pin tumblers so as to achieve a same total tumbler height within each given pin chamber 40. Therefore, the measurement of the pin tumblers 20 height to determined key bitting or combination of the lock cylinder is ineffective and cannot be decoded to produce a correct key. Therefore, generally the bottom pin tumblers 20 may have different lengths or heights and the top pin tumblers 20 may have corresponding lengths or heights, such that the total height of all six pin tumblers 20 may be or may not be the same for the lock 10. Both portions of the pin tumblers 20 may have a predetermined diameter. This diameter generally may include an outer diameter that is generally the same as or slightly smaller than the diameter of the orifices 56 arranged in a top surface of the cylinder key plug 18. Generally, the outer surfaces of the pin tumbler 20 bottom and top portions are smooth. One end of the bottom portion of the pin tumbler 20 may have a coned or conical shape, which allows for the pin tumblers 20 to move in a vertical or other predetermined direction along the surfaces of the key arranged in the key way 54 and to be placed in the correct position when the key is inserted to create an open or unlocked position for the pin tumblers 20 with relation to the pin tumbler cylinder lock 10. The two outer pin tumblers 20 arranged within the end pin chambers 40 may have a coil spring 22 arranged between a top end of the pin tumbler 20 and the spring cap 44. The coil spring generally 22 may have any known height and may have any known predetermined spring force or compression thus providing the necessary force between the spring cap 44 and the top surface of the top portion of the pin tumbler 20. It should be noted that arranged within the four middle pin chambers 40 may be a ball bearing 14. The ball bearing 14 generally has an outer diameter slightly less than the inner diameter of the middle four pin chambers 40 of the cylinder housing 16. As noted above, the diameter of the middle four pin chambers 40 is larger than the diameter of the outer two pin chambers 40 of the cylinder housing 16. Hence, the ball bearing 14 arranged in each of the four middle pin chambers 40 has a similar outer diameter or slightly smaller outer diameter than the diameter of the middle four pin chambers 40. Arranged above and in contact with the ball bearing 14 may also be a coil spring 22 that also contacts the spring cap 44 on the opposite end thereof. It should be noted that the length of the coil springs 22 arranged within the middle four pin chambers 40 generally may be less than the length of the coil springs 22 arranged in the outer two pin chambers 40. However, it is also contemplated that all of the pin chambers 40 have the exact same length springs depending on the design requirements and environment in which the pin tumbler cylinder lock 10 may be used. It should further be noted that the top end of the four pin tumblers 20 arranged in the middle four pin chambers 40 may include a serrated or threaded portion 62. In one contemplated embodiment, the top portion of the top pin tumblers 20 of the middle four pin chambers 40 may have serrations 62 that extend a predetermined distance such that predetermined distance also is the same as the distance that the serrated or threaded surface 42 is arranged within the bottom portion of the middle four pin chambers 40. This may be anywhere from a sixty fourth of an inch to many inches depending on the size of the two piece pin tumblers 20 arranged within the pin tumbler cylinder lock 10. Thus, interaction may occur between the serrated outer surface 62 of the pin tumblers 20 and the serrated inner orifice 42 of the middle four pin chambers 40 to ensure a pick proof lock in any picking situation. It should be noted that all of the components described herein generally are made of a brass or iron material, however any other metal, ceramic, plastic, composite or natural material may be used for any of the components and keys used in the pin tumbler cylinder lock 10 according to the present invention.

As noted above, the pin tumbler cylinder lock 10 of the present invention may be utilized within any pin tumbler lock known but particularly of the cylinder type as shown in the drawings. As noted above, the cylinder housing 16 includes a single inner bore 34 which is used to accept and secure a cylinder key plug 18 therein while also having a cavity or cutout 36 arranged within the cylinder housing 16 in order to receive and allow for a lockout sleeve 12 to rotate therein. The cylinder key plug 18 includes a predetermined keyway 54 that in one particular embodiment is a paracentric type keyway however any other known keyway may also be used to obstruct easy accessibility to the pin tumblers 20 so as to impede lock picking. It should be noted that the periphery of the cylinder key plug 18 and periphery of the lockout sleeve 12 form two independent divisional shear lines for the pin tumbler cylinder lock 10 according to the present invention. The first shear line arranged at the outer periphery of the cylinder key plug 18 functions to operate the cylinder lock 10 when a correct key is entered into the keyway 54. Wherein, the second shear line arranged at the outer periphery of the lockout sleeve 12 may function as to create an unpickable or lock out mode where a person is attempting to pick the pin tumbler cylinder lock 10. The pin tumbler 20 arranged in the first and last pin chambers 40 may achieve a specified tumbler height in both pin chambers and may function as a typical pin tumbler cylinder lock mechanism. The remaining four middle pin chambers 40, which have the enlarged diameter in the cylinder housing 16 and the serrated lower section 42 therein, use the dissimilarity in the height of the bottom tumblers to determine the size of the correlated top tumblers so as to achieve the same tumbler height within each of the middle four pin chambers 40. This arrangement functions as a means to place the lock 10 into an unpickable mode when someone is attempting to pick the lock. With the pin tumbler 20 arrays as shown in the middle four chambers 40 are at rest or the lock mode, i.e., the bottom pin tumblers 20 in the cylinder key plug 18 and the correlated serrated top pin tumblers 20 extending into the pin chambers 60 of the lockout sleeve 12 with a specified height producing depression at the second shear line for placement of the ball bearing 14 thereat. This thereby creates friction free rotational resistance at the second shear line resulting in the second shear line being compromised once rotational tension is applied to the integrated cylinder key plug 18 while lock picking is occurring, thereby permitting the cylinder key plug 18 and the lock out sleeve 12 to rotate together wherein the lockout sleeve 12 acts as a lockout stop for the pin tumbler cylinder lock 10 which may terminate into the lockout cavity 36 subsequently neutralizing any further picking of the pin tumbler cylinder lock 10. Therefore, it must be noted that the above scenario may only be realized when the pin tumblers 20 in the first and last pin chambers 40 have already been picked. Therefore, when rotational tension which is essential for lock picking, is applied to the key plug 18 this tension is placed only on the pin tumblers 20 in the first and last pin chambers 40, thus permitting picking of those first and last pin chambers 40 due to the correct diameter of the pin chambers 40. Wherein with the middle four pin chambers 40 in the cylinder housing 16 being of a larger diameter and having a friction free ball bearing 14 arranged therein may not permit rotational tension to be placed on the top portion of the serrated pin tumblers 20 arranged therein. Hence, counteracting the manipulation of the pin tumblers 20 in the middle four pin chambers 40. Therefore, to a person skilled in the art once the first and last pin tumblers 20 in the first and last pin chambers 40 are picked the lockout sleeve 12 and cylinder key plug 18 may rotate and terminate or contact against an inner wall of the lock out cavity 36 resulting in a lockout stage or mode for the pin tumbler cylinder lock 10. In the event that the middle four pin tumblers 20 may be permitted to bind through rotational tension, the result may be a serration lockup wherein the pin tumblers 20, due to the engagement of the serrated top tumblers 20 arranged therein, with the lower serrated 42 section of the middle four pin chambers 40 may prohibit movement of the pin tumblers 20 which is vital to lock picking. It should be noted that releasing the tension on the cylinder key plug 18 so as to regain movement of the pin tumblers 20 may permit all of the pin tumblers 20 in the first and last pin chambers 40 to revert to the rest position and consequently reset the cylinder lock 10 to its lock mode.

As shown in the figures when a correct key is inserted into the cylinder key plug 18 through the keyway 54 this may elevate the pin tumblers 20 in the first and last pin chambers 40 so that the top of the bottom pin tumblers 20 are level with the first shear line and in turn elevates the correlated top pin tumblers 20 into the chambers 40 of the cylinder housing 16. The four bottom pin tumblers 20 of the four middle pin chambers 40 are also elevated and level with the first shear line such that the top serrated pin tumblers 20 may be elevated through the lockout sleeve 12 into the middle four chambers 40 of the cylinder housing 16 thus creating a stationary mode for the lockout sleeve 12 with respect to the cylinder key plug 18. This stationary mode of the lockout sleeve 12 may permit the cylinder key plug 18 to rotate within the lockout sleeve 12 independent of the same resulting in an unlocked state of the cylinder key plug 18 and lock 10. It should be noted that the arrangement of the ball bearings 14 may not interact with correct key operation as they are moved up into the four middle pin chambers 40. When the key 64 is withdrawn the bottom pin tumblers 20, correlated top pin tumblers and the serrated top pin tumblers may drop into or towards the cylinder key plug 18 with the remaining top section of the pin tumblers 20 setting above the first shear line extending into the pin chamber 40 of the cylinder housing 16 and the serrated top pin tumblers 20 setting above the first shear line and extending into the lockout sleeve 12 terminating at the second shear line and depression which may be arranged at a top surface of the lockout sleeve 12, thereby interlocking the lockout sleeve 12 with the cylinder key plug 18. It should be noted that the interlocked unit of the cylinder key plug 18 and the lockout sleeve 12 may be held in alignment by the first and last pin tumblers 20, the arrangement of the ball bearings 14 and the position of the top pin tumblers 20 of the middle four pin chambers 40 resulting in a locked stage or mode of the cylinder key plug 18 culminating in a locked mode of the pin tumbler cylinder lock 10.

In operation, the periphery of the lockout sleeve 12 and the cylinder key plug 18 form independent divisional shear lines respectively as noted above. The pin tumbler cylinder lock 10 of the present invention having an integrated lockout sleeve 12 and the cylinder key plug 18 within the cylinder housing 16 allows the former to act as a means to prevent lock picking in conjunction with the ball bearing 14 arrangement arranged therein. This may allow the key plug to operate as a conventional pin tumbler cylinder lock 10 when a key is arranged therein. Also, the pin tumbler cylinder lock 10 of the present invention may have the middle four pin chambers 40 of the cylinder housing 16 over sized to receive a single oversized ball bearing 14 in each of those chambers 40. This may create a point of least resistant at the lockout sleeve 12 or second shear line when lock picking is attempted. However, the ball bearings 14 may not enter the chambers 60 of the lockout sleeve 12 due to their size being larger than the orifices or pin chambers 60 arranged through the lockout sleeve 12, but may permit rotation of the lockout sleeve 12 into the cavity or lockout cavity 36 creating an unpickable mode. Hence, the arrangement of the larger ball bearings 14 may not interact with the function of a correct key being placed within the keyway 54. It should further be noted that the cylinder housing 16 of the present invention having the first and last pin chambers 40 of a conventional diameter and size unlike the middle four oversized pin chambers 40 may become instrumental in creating a virtually pick proof cylinder lock due to the interaction of the dis-similarity therebetween. It should further be noted that having the top serrated pin tumblers 20 in the middle four pin chambers 60 of the lockout sleeve 12 when the correct key is utilized may allow the pin tumblers 20 to partly elevate into the middle four pin chambers 40 of the cylinder housing 16 thereby creating a stationary mode of the lockout sleeve 12 with respect to the cylinder key plug 18 thus the cylinder key plug 18 is free to rotate in this unlocked state. The rotation occurs between the lockout sleeve 12 and the cylinder key plug 18 such that the user of the lock 10 does not realize that the lockout sleeve 12 is arranged within the pin tumbler cylinder lock 10 unless picking of the lock is being attempted. Furthermore, the cylinder key plug 18 includes the paracentric type keyway 54 which may further obstruct easy accessibility to the tumblers to further impede locking picking by either a lock picking mechanism or a lock picking professional. Also, it should be noted that having the cutout cavity 36 arranged in the lower section of the cylinder housing 16 may act as a stop for the lockout sleeve 12 when it rotates with the cylinder key plug 18 into the cavity 36 when lock picking is attempted. Thus, a lockout mode may be created and in this mode it is literally impossible to pick the lock 10. However, it should be noted that normal cylinder function may be restored to the lock 10 by simply reversing rotation of the cylinder key plug 18 to the neutral position or locked mode thus allowing for all of the pin tumblers 20 to reach their neutral position.

Figure 10:
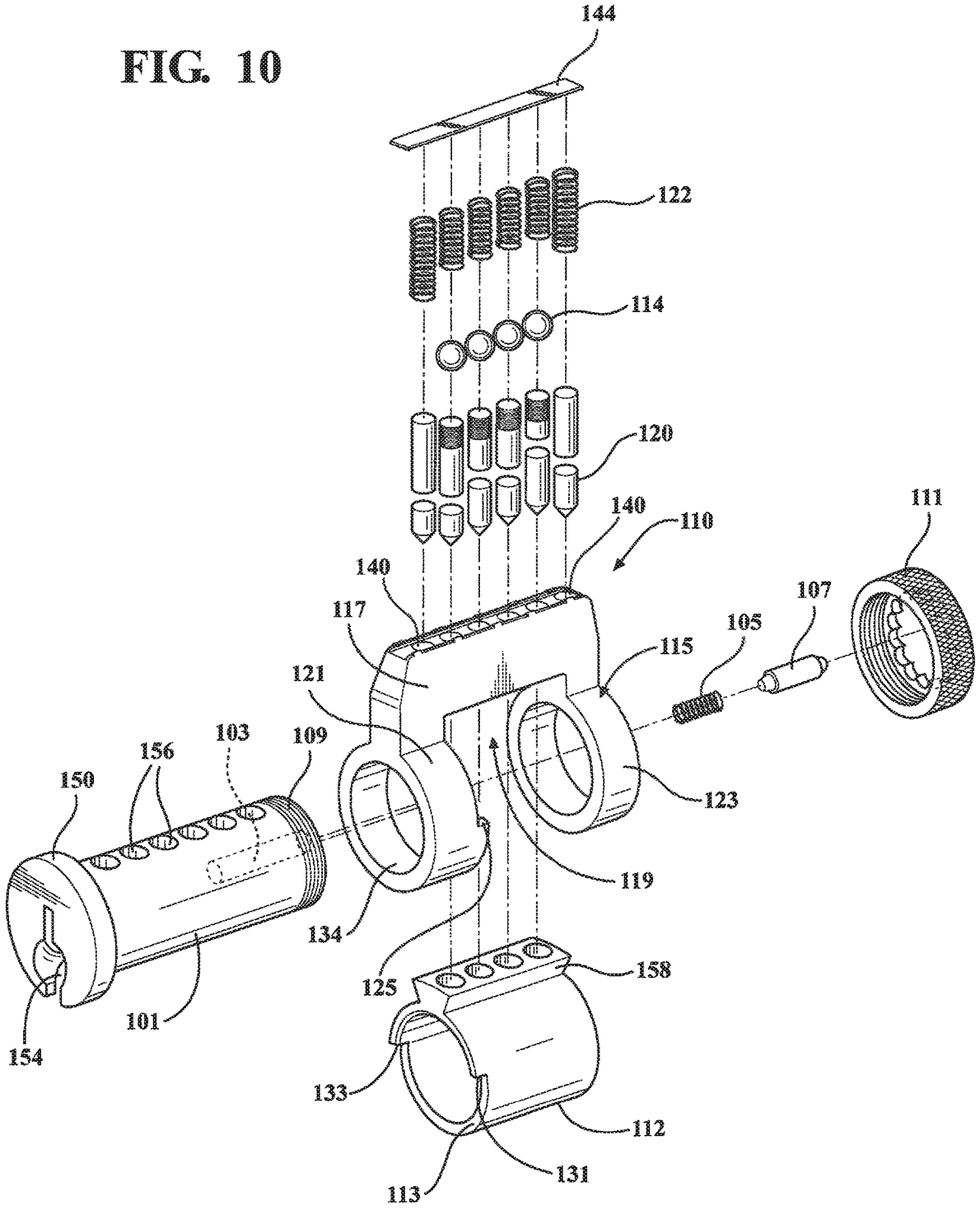
FIG. 10 shows an exploded view of an alternate embodiment of a pin tumbler cylinder lock according to the present invention.
Figure 11:
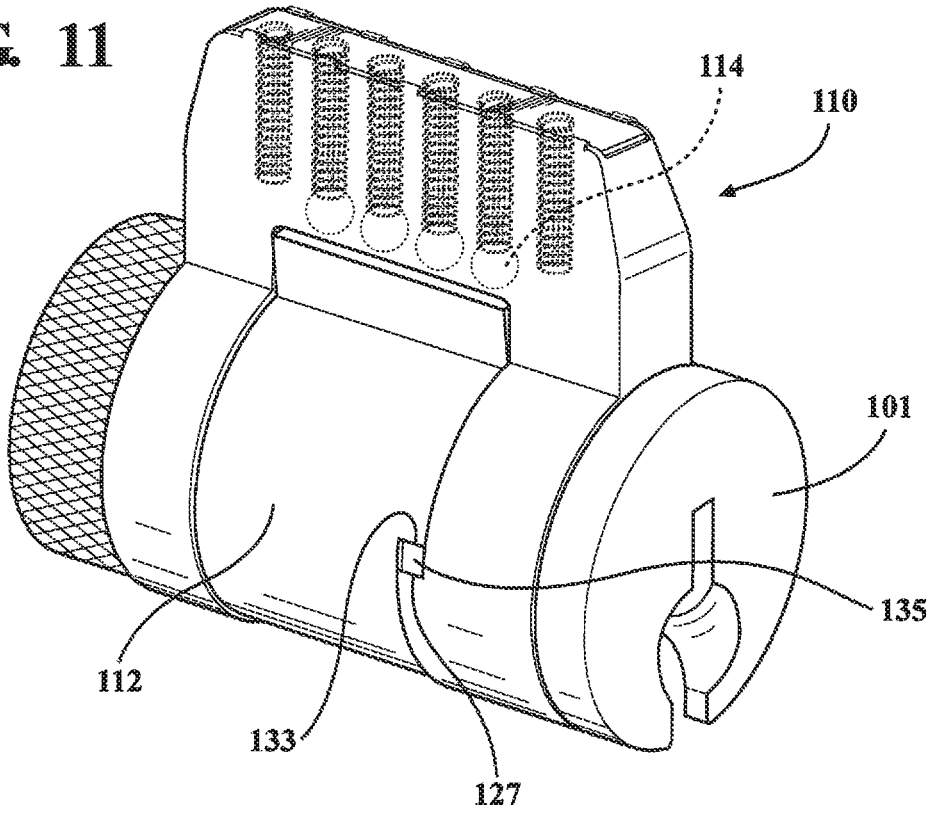
FIG. 11 shows a plan view of an alternate embodiment of a pin tumbler cylinder lock according to the present invention.
Figure 12:
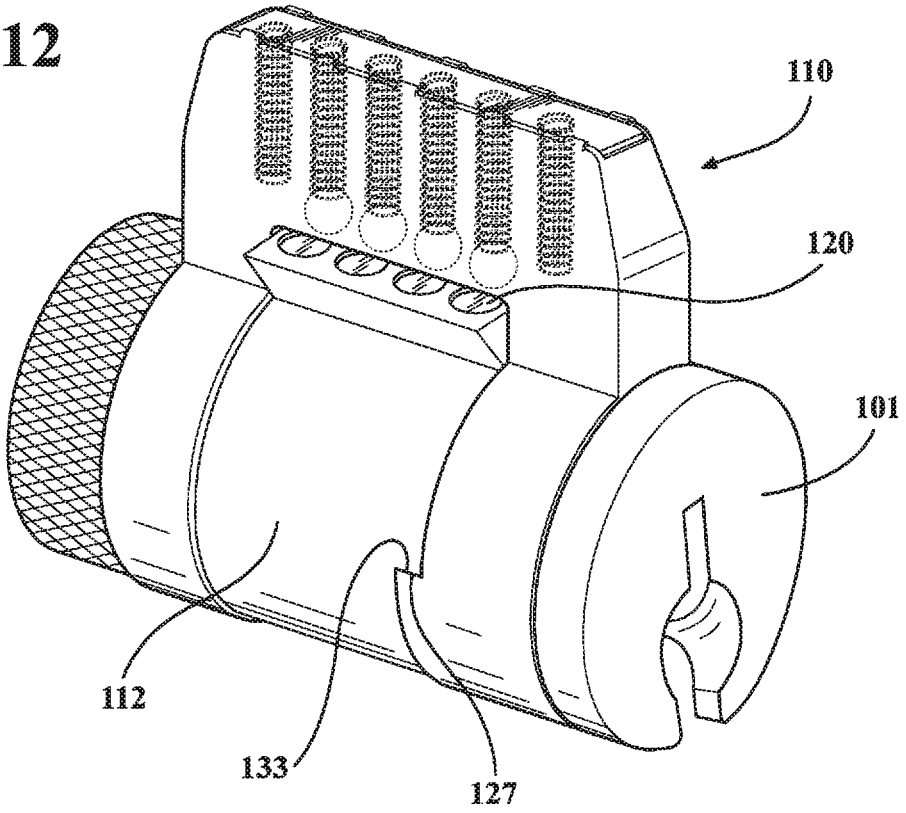
FIG. 12 shows a perspective view of the alternate embodiment of a pin tumbler cylinder lock in a lock out position.
Figure 13:
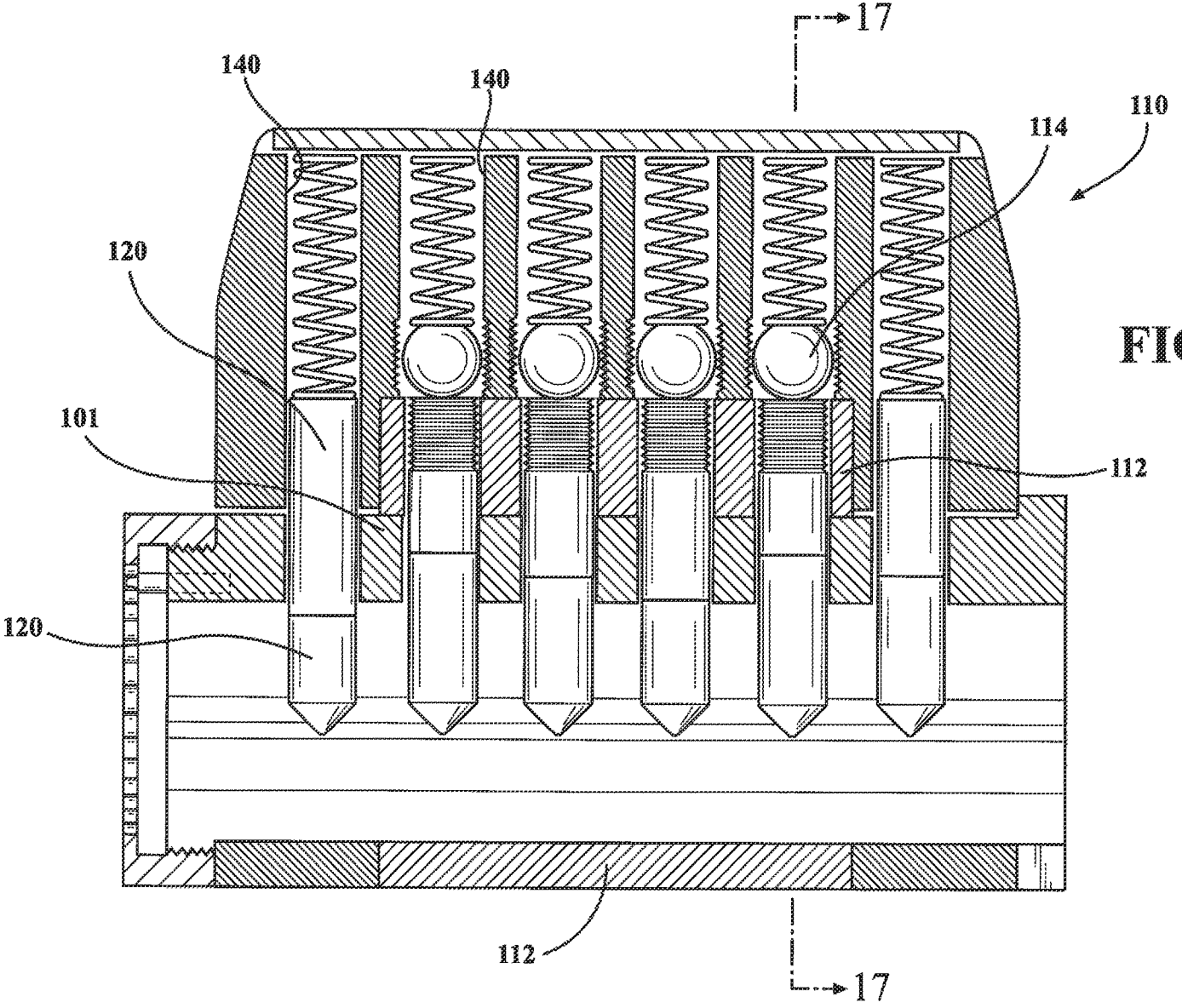
FIG. 13 shows a partial cross sectional view of an alternate embodiment of the pin tumbler cylinder lock in a locked position according to the present invention.
Figure 14:
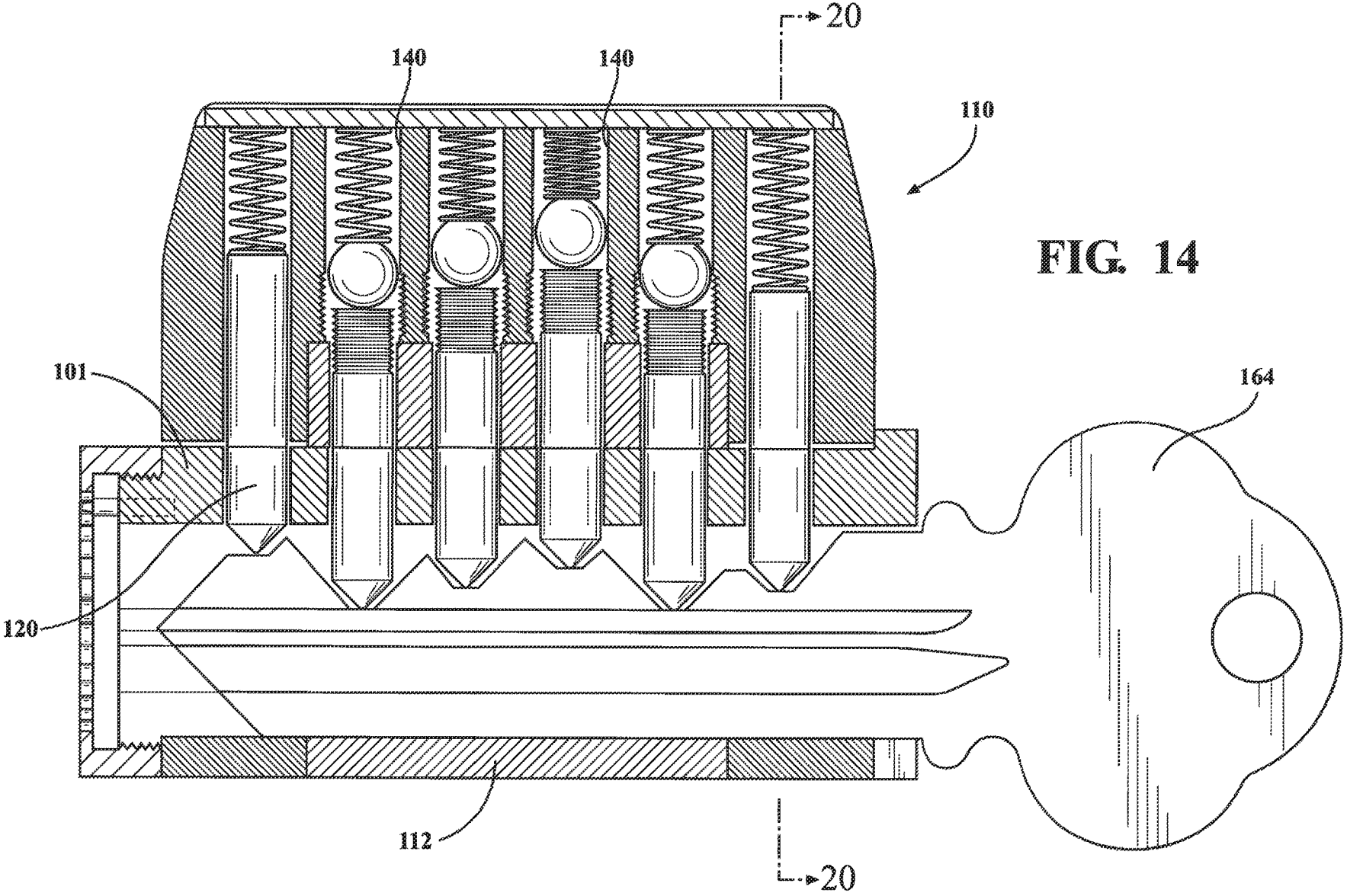
FIG. 14 shows a partial cross sectional view of an alternate embodiment of a pin tumbler cylinder lock in an unlocked position according to the present invention.
Figure 15:
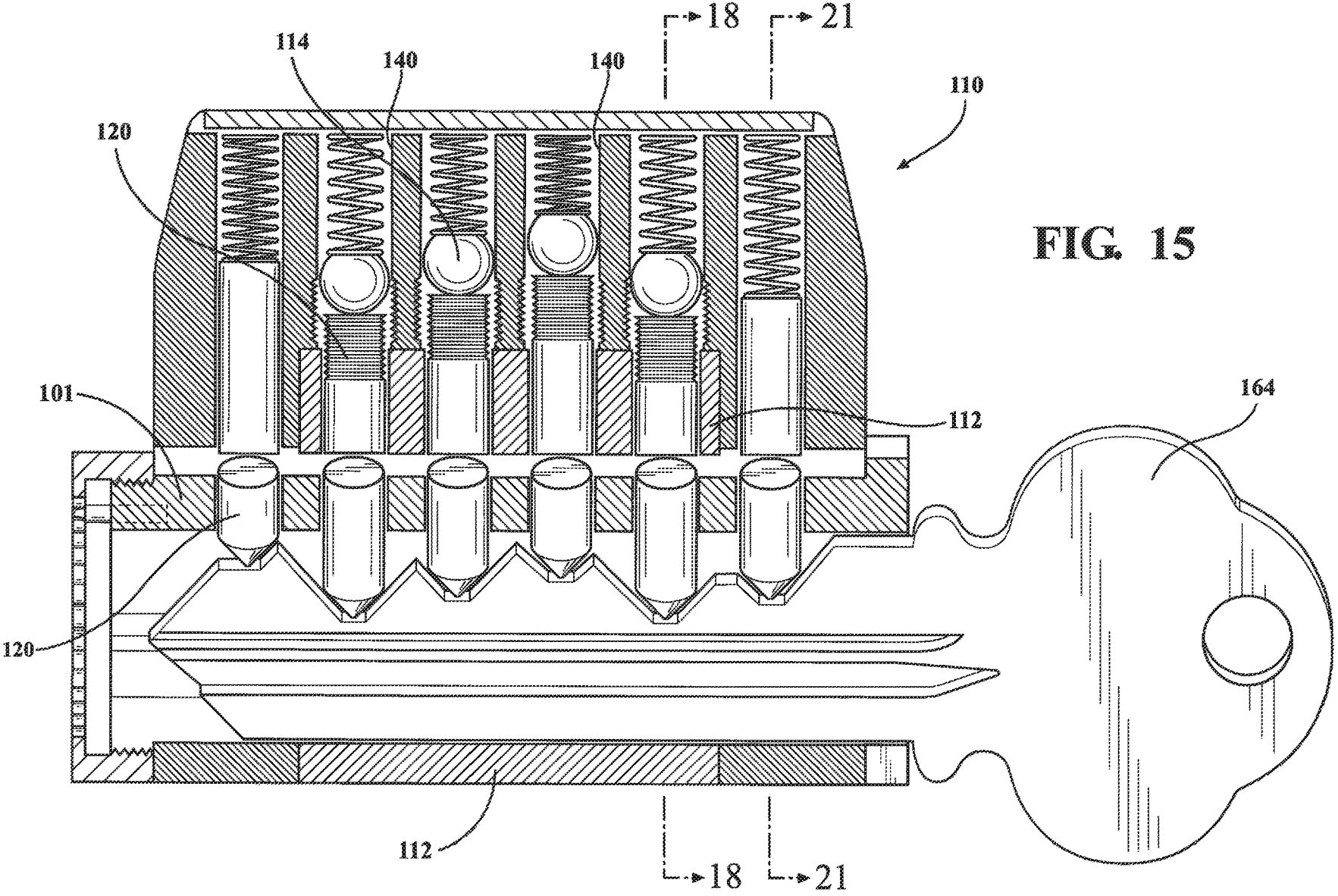
FIG. 15 shows a partial cross sectional view of an alternate embodiment of a pin tumbler cylinder lock in an unlocked rotated position according to the present invention.
Figure 16:
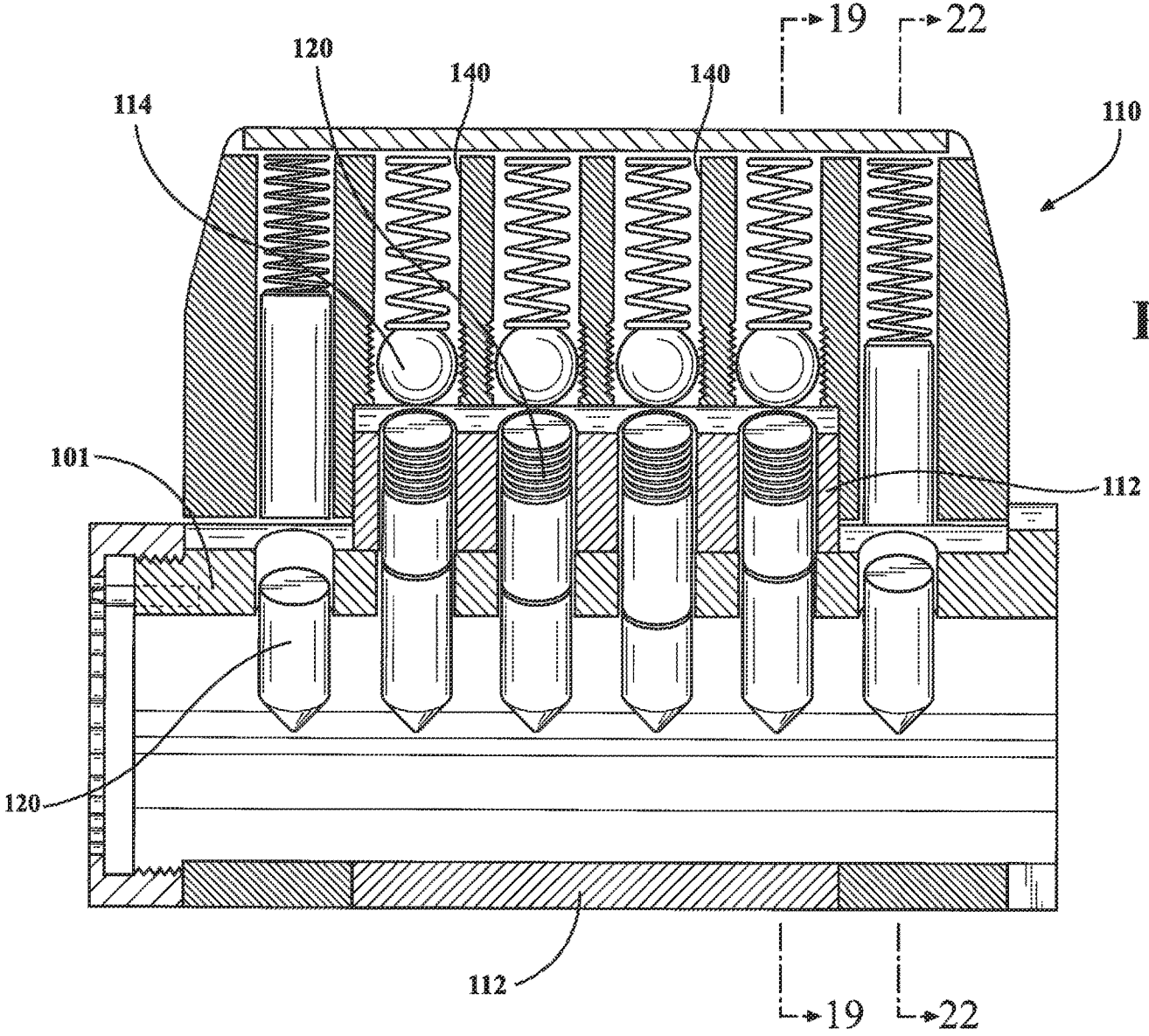
FIG. 16 shows a partial cross sectional view of an alternate embodiment of a pin tumbler cylinder lock in lockout mode according to the present invention.
Figure 19:
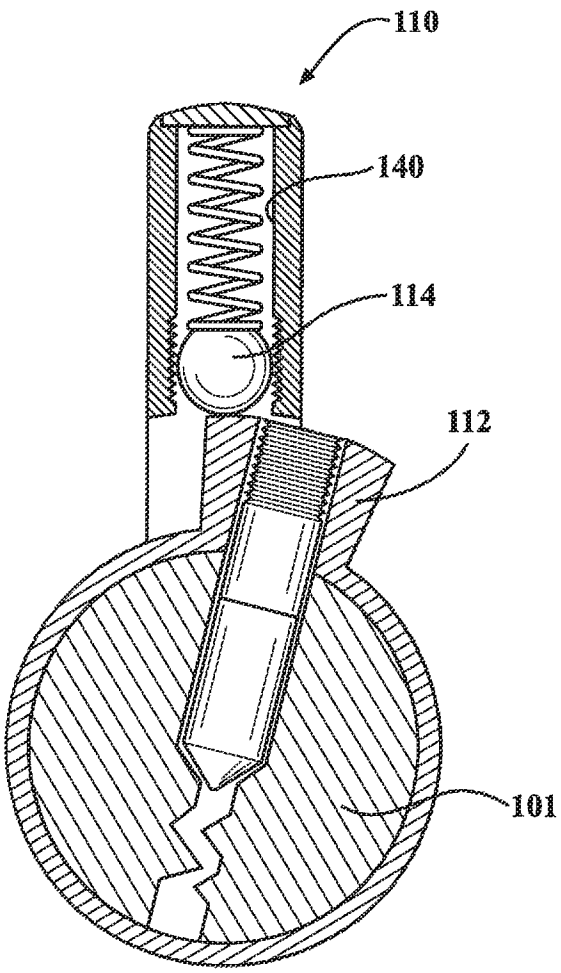
FIG. 19 shows a cross sectional view of an alternate embodiment of a pin tumbler cylinder lock taken along line 19-19 of FIG. 16 according to the present invention.
Figure 18:
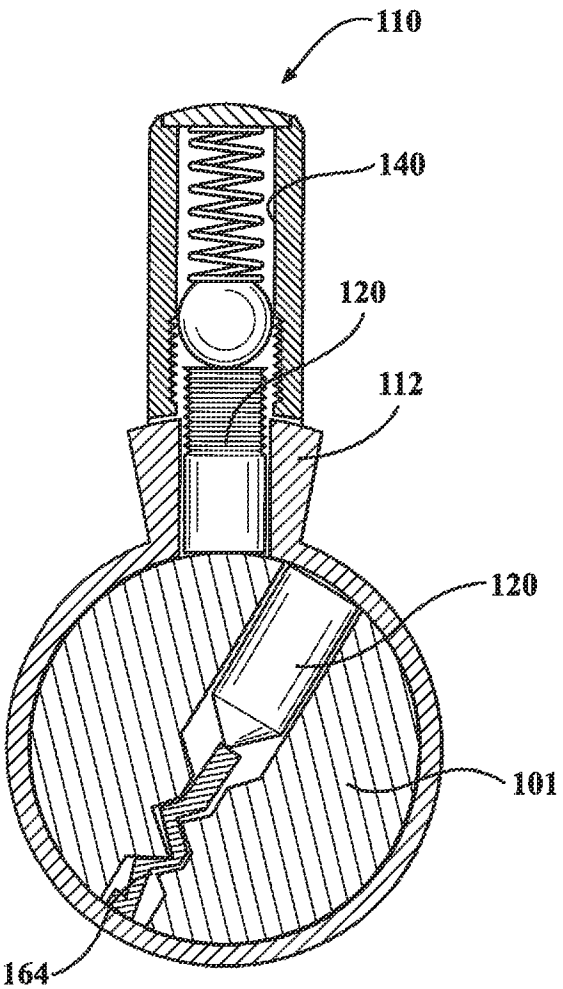
FIG. 18 shows a cross sectional view of an alternate embodiment of a pin tumbler cylinder lock taken along line 18-18 of FIG. 15.
Figure 17:
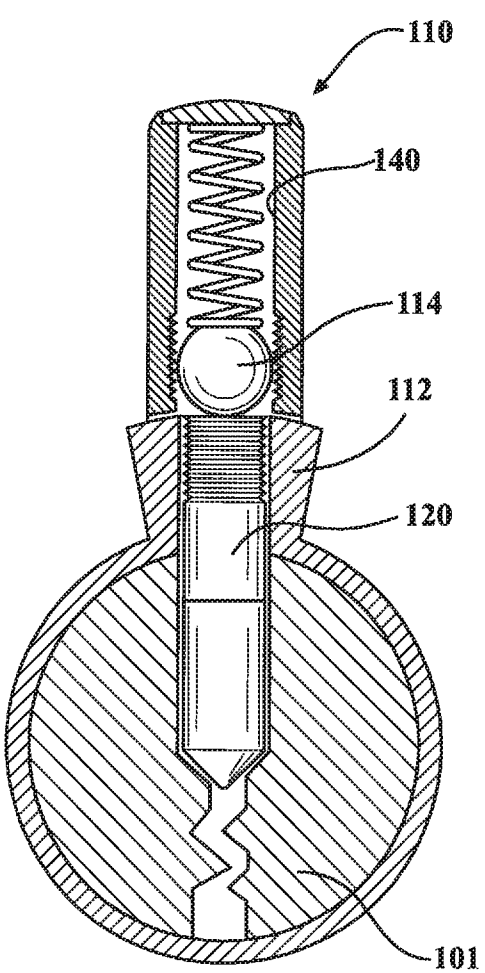
FIG. 17 shows a cross sectional view of an alternate embodiment of a pin tumbler cylinder lock taken along line 17-17 of FIG. 13 according to the present invention.
Figure 22:
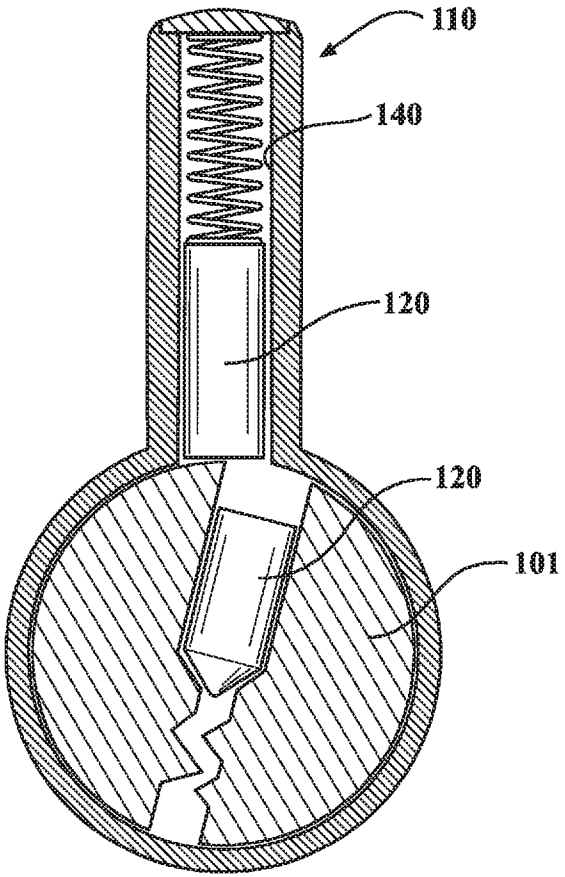
FIG. 22 shows a cross sectional view of an alternate embodiment of a pin tumbler cylinder lock taken along line 22-22 of FIG. 16 according to the present invention.
Figure 21:
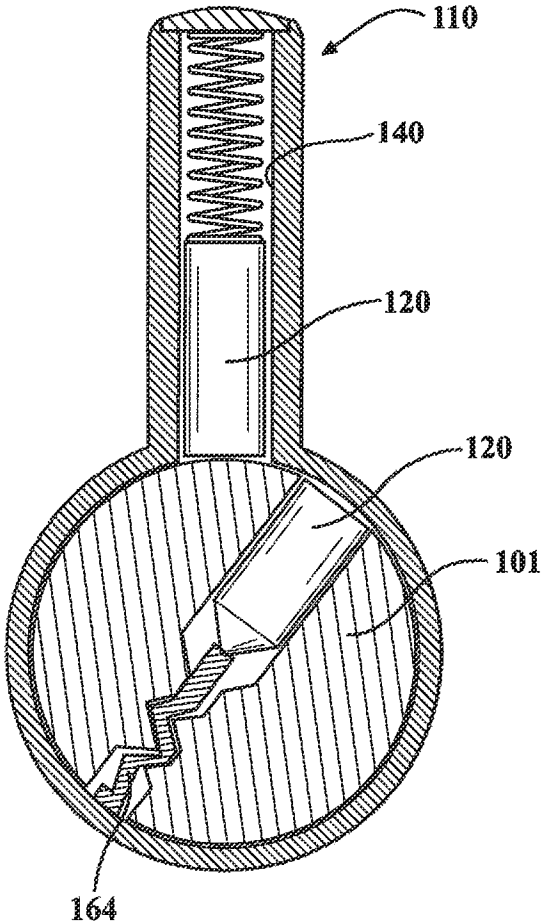
FIG. 21 shows a cross sectional view of an alternate embodiment of a pin tumbler cylinder lock taken along line 21-21 of FIG. 15 according to the present invention.
Figure 20:
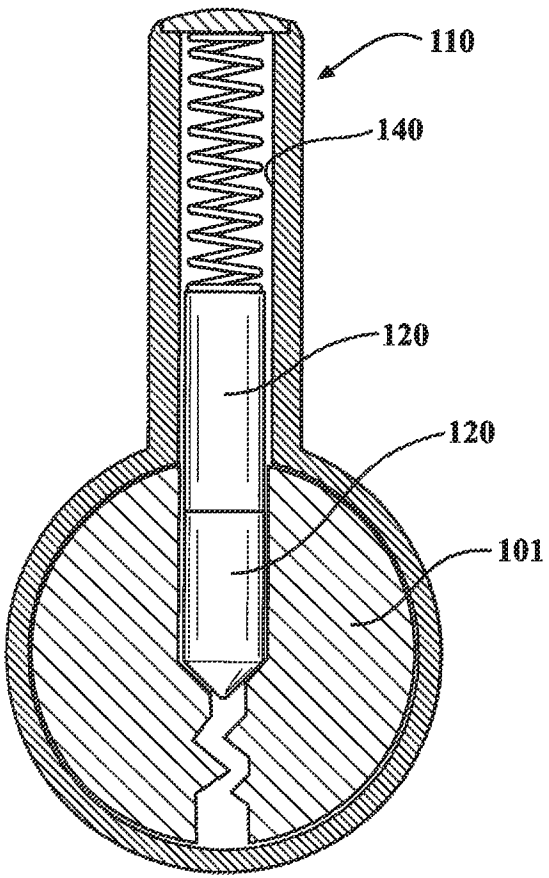
FIG. 20 shows a cross sectional view of an alternate embodiment of a pin tumbler cylinder lock taken along line 20-20 of FIG. 14 according to the present invention.

An alternate embodiment of the pin tumbler cylinder lock 110 according to the present invention is shown in FIGS. 10 through 22. Like numerals indicate like parts. It should be noted that the pin tumbler cylinder lock 110 of the alternate embodiment is capable of being used both indoors and outdoors and generally is used as a key in knob or within a dead bolt of a door or other component. The pin tumbler cylinder lock 110 may be used in a door lock, pad lock, deadbolt or any other type of lock that uses a pin tumbler cylinder lock therein. The pin tumbler cylinder lock 110 includes a cylinder lock housing or cylinder housing 115. The cylinder lock housing 115 generally has a cylindrical shape of any known dimension and it may include a flange or chamber flange 117 extending from an outside surface thereof. It should be noted that the cylinder housing 115 generally is made of a brass or iron material, however any other type of metal, ceramic, plastic, composite or natural material may be used to create the cylinder housing 115 of the present invention and all of the other components of the present invention. The cylinder housing chamber flange 117 generally may have a rectangular shape when viewed from a side and from a top thereof. The chamber flange 117 may have any known width and length and generally extends from an outside outer circumferential surface of the cylinder housing 115. The cylinder housing 115 generally may have a single bore 134 arranged through a mid point thereof. The cylinder housing 115 may also include a cutout portion or notch 119 arranged within or near a middle section thereof. The notch or cutout portion 119 generally is machined out of the body of the cylindrical housing 115 and a small rectangular portion machined out of the chamber flange 117 that extends from a side of the cylindrical housing 115. After the cutout portion 119 has been removed from the cylindrical housing 115, the cylindrical housing 115 generally may include a first and second ring 121, 123 that are parallel to one another and have the single bore 134 arranged along a common axis of the first and second ring 121, 123. The flange 117 may engage and extend from an outer surface of the first and second ring 121, 123 formed after the cutout portion 119 is removed from a generally middle area of the cylindrical housing 115. Arranged on at least one or maybe both of the rings 121, 123 of the cylindrical housing 115 may be a first shoulder or stop surface 125. It is also contemplated to use a second shoulder or stop surface 127 arranged on the same ring as the first shoulder or stop surface 125 at an approximate 180° from the first shoulder or stop surface 125. However, it should be noted that the stop surfaces 125, 127 may be arranged at any other known separation of degrees other than 180° depending on the environment and the design of the pin tumbler lock 110. The first and second shoulder or stop surfaces 125, 127 arranged on an inner edge of the cutout portion 119 of the cylindrical housing 115 may also be described as the ends of a circumferential flange that extends from an inner surface of one or both of the rings 121, 123 of the cylindrical housing 115 after the cutout portion 119 is removed from the cylindrical housing 115. Hence, this half circle circumferential flange may extend from either one or both of the inside surfaces of the rings 121, 123 formed by the cutout portion 119 of the cylindrical housing 115. These shoulder surfaces 125, 127 of the first or second ring 121, 123 may be any predetermined length and width. The half circle circumferential flange, which may define the shoulder or stop surfaces 125, 127, generally is arranged on a bottom portion of at least one or both of the rings 121, 123 forming the cylindrical housing 115 according to the present invention. It should be noted that the semi-circular circumferential flange may have any known number of degrees and may cover more than approximately 180° such that it may extend anywhere between 0 to 360° from of an inside portion of either one or both of the rings 121, 123. It should be noted that it is contemplated that the cutout portion 119 of the cylindrical housing 115 may either be machined or casted directly into the cylindrical housing 115 during making of the pin tumbler cylindrical lock 110. The chamber flange 117 extends between an outer surface of the first 121 and second ring 123 wherein the first 121 and second ring 123 defines the cutout portion or notch 119 removed from the cylindrical housing 115 during manufacturing or after market installation thereof. Therefore, the cutout portion, notch or cavity 119 arranged within a bottom surface of the cylindrical housing 115 may be of any known shape or size depending on the design requirements of the lock 110.

Arranged within the chamber flange 117 may be a plurality of orifices or pin chambers 140 that extend a predetermined distance through the chamber flange 117 and/or cylinder housing 115. It should be noted that the plurality of orifices or pin chambers 140 generally are sized, shaped and operate in the same manner as that described above for the first embodiment disclosed herein. The alternate embodiment also includes a plurality of two piece pin tumblers 120, coil springs 122 and ball bearings 114 such as those described above for the first embodiment. The pin tumbler cylinder lock 110 of the alternate embodiment of the present invention may also include a cylinder key plug 101. The cylinder key plug 101 generally may have a cylindrical shape that is generally the same length or slightly smaller or longer than the cylinder housing 115. Arranged on one end of the cylinder key plug 101 may be a first orifice 103. Generally, this first orifice 103 is circular in shape and may have a smooth or threaded inner surface. Arranged within the first orifice 103 may be a coil spring 105, a key or lock key 107. The spring 105 and lock key 107 are arranged within the first orifice 103 on the end of the cylinder key plug 101 and the lock key 107 may extend out from the orifice 103. The cylinder key plug 101 may also include a plurality of threads 109 arranged on an outer surface at an end thereof. The threads 109 on the outer surface of the end of the cylinder key plug 101 may be used to receive a cylinder key plug end cap 111 that has a threaded inner orifice. The cylinder key plug end cap 111 generally may have a circular shape with an orifice therethrough with threads arranged on an inner surface thereof and a keyed orifice arranged on an opposite end thereof, wherein the keyed orifice is arranged around an entire inner edge of the cylindrical key plug end cap 111. This keyed orifice generally may have semi-circular cutouts arranged along the entire inner circumference of one end of the cylinder key plug end cap 111. These semi-circular or any other known or U-shaped cutouts may be used to interact with the lock key 107 arranged within the first orifice 103 of the cylinder key plug 101. A cam maybe arranged between the end cap 111 and the first end of the cylinder key plug 101 such that it is fixed with respect to the cylinder key plug 101 and may allow for the cam to rotate when the cylinder key plug 101 is rotated via the use of a key 164 arranged within a key way 154 of the cylinder key plug 101. Hence, the end cap 111, cylinder key plug 101 and cam may all be fixed rotatively to one another and may all rotate as one unit and this rotation will occur with respect to the cylinder housing 115 of the pin tumbler lock 110. It should be noted that any known shape may be used for the cam of the pin tumbler cylinder lock 110 of the alternate embodiment of the present invention, including but not limited to a rectangular cam connected to a disc base or any other known disc shape base connected to any other known arm extending therefrom to allow for rotation of the cam with respect to the cylinder housing 115. It should be noted that the cam may also include at least a circular orifice or semi-circular orifice that may be used to receive the lock key 107 within such orifice such that the lock key 107 may be arranged between the semi-circular orifice of the cam and the semi-circular orifice of the keyed orifice of the end cap 111 thus allowing for the cam to be rotatably secured with respect to both the end cap 111 and the cylinder key plug 101. It should be noted that the cylinder key plug 101 generally may have a length that is slightly larger than the length of the cylinder housing 115 thus allowing for a cam to be securely fastened to an end of the cylinder key plug 101 while also along for rotation with respect to the end of the cylinder housing 115. However, any other length cylinder key plug 101 including one that is slightly shorter, the same length or much longer than the cylinder housing 115 may also be used. The cylinder key plug 101 on one end thereof may have a circumferential flange 150 extending around the outer periphery thereof. The circumferential flange 150 generally may mate with and interengage with an outer end surface on the front face of the cylinder housing 115. Generally, the circumferential flange 150 of the cylinder key plug 101 may have the same outer diameter as the cylindrical housing 115 thus ensuring an aesthetically pleasing front, flat face for the pin tumbler cylinder lock 110 according to the alternate embodiment of the present invention. The cylinder key plug 101 also may include a paracentric key way 154 arranged along an entire or partial length thereof. The paracentric key way 154 may obstruct easy accessibility to the tumblers arranged within the pin tumbler cylinder lock 110, thus leading to a impediment for lock picking. It should be noted that any other type of key way 154 may also be used in the cylinder key plug 101 described herein. It should be noted that the cylinder key plug 101 may have an outer diameter that is slightly less than the inner diameter of the inner bore of the cylinder housing 115, thus allowing for a free rotation between the cylinder housing 115 and the cylinder key plug 101. It is also contemplated to put a plurality of bearings or other rotational aides between the inner bore of the cylinder housing 115 and the outer surface of the key plug 101. The key plug 101 also may include a plurality of circular orifices or pin chambers 156 arranged in a top surface thereof. The circular orifices 156 may extend between an outer surface of the key plug 101 into the key way 154 of the cylinder key plug 101. The circular orifices 156 may have a predetermined diameter that may generally match or be equal to the diameter of the two end pin chambers 140 of the cylinder housing 115. All of the orifices 156 through the top surface of the cylinder key plug 101 may have the same diameter.

The alternate embodiment of the pin tumbler cylinder lock 110 of the present invention may also include a lock out sleeve 112. Generally, the lock out sleeve 112 may have the same shape as that for the embodiment described above. The lock out sleeve 112 of the alternate embodiment may have a shape that may mimic that of the cutout portion 119 of the cylindrical housing 115. Hence, when the lock out sleeve 112 is arranged within the cylindrical housing 115, the lock out sleeve 112 may complete the inner bore of the cylindrical housing 115 as if the cutout portion had not been removed from the cylindrical housing 115. In the alternate embodiment the lock out sleeve 112 may include an inward extending notch 113 extending from a first end thereof. This inward extending notch 113 generally may have a semi-circular shape, or a smaller or larger than semi-circular shape and be removed from a bottom portion of an end of the lock out sleeve 112. This may in effect create a first and second shoulder or stop surface 131, 133 arranged on the first end of the cylinder lock out sleeve 112. It should be noted that it is also contemplated to use an inward extending notch from the second end of the lock out sleeve 112 depending upon the design requirements of the pin tumbler cylinder lock 110. The first and second shoulder surface 131, 133 formed by the inward extending notch 113 of the lock out sleeve 112 may interact with and interengage with the first and second shoulder 125, 127 of the cylinder housing 115. Hence, when the lock out sleeve 112 is arranged within the cutout portion 119 of the cylinder housing 115 the lock out sleeve 112 may complete the inner bore. When the lock out sleeve 112 is arranged within the cutout portion 119 of the cylinder housing 115 the top of the lock out sleeve 112 having the arcuate or any other shaped flange 158 extending therefrom may be arranged within the portion of the cutout 119 arranged within the chamber flange 117 of the cylinder housing 115. The first and second shoulder 131, 133 of the lockout sleeve 112 may be arranged directly across from the first and second shoulder 125, 127 respectively, of the cylindrical housing 115. Arranged between the first and second shoulder 131, 133 of the lock out sleeve 112 and the first and second shoulder 125, 127 of the cylindrical housing 115 may be a predetermined shaped gap 135. The gap 135 is visible when the pin tumbler cylinder lock 110 is in a locked position or key operating status position. This gap 135 may be any known dimension. It should be noted that the lock out sleeve 112 generally may have a length that allows for the lock out sleeve 112 to be arranged within generally the entire cut out portion 119 of the cylinder housing 115 but still allow for rotation of the lock out sleeve 112 with respect to the cylinder housing 115 when a lock picking stage or attempt is encountered. If a person attempts to pick the lock 110, via any known picking mechanism known in the art, the lock out sleeve 112 of the pin tumbler cylinder lock 110 may rotate with respect to the cylinder housing 115. The lock out sleeve 112 may rotate a predetermined distance which is defined by the length of the gap 135 arranged between the first and second shoulders 131, 133 of the lock out sleeve 112 and the first and second shoulders 125, 127 of the cylinder housing 115. Hence, when the lock 110 is being picked the second shoulder 133 of the lock out sleeve 112 may engage with the second shoulder 127 of the cylinder housing 115 during lock picking. However, if during the lock picking the lock is attempted to be turned in a clockwise direction, then the first shoulder 131 of the lock out sleeve 112 may engage with the first shoulder 125 of the cylinder housing 115 thus creating a pick proof lock by not allowing the middle four pins 120 of the pin tumbler lock 110 to be accessed by the person picking the lock. The lock out sleeve 112 is capable of rotating in a clockwise or counter clockwise direction during a picking attempt of the pin tumbler cylinder lock 110 and may engage the shoulder surfaces on either side thereof in order to stop the picking of the middle four pin chambers 120 from occurring, thus creating a lock out scenario which creates a virtually pick proof pin tumbler cylinder lock 110. It should be noted that the spring cap 144 is also arranged on the outer surface of the chamber flange 117 of the cylinder housing 115 in order to hold the coil springs 122 and two piece pins 120 within the chambers 140 of the pin tumbler lock 110. It should be noted that all of the pins 120, ball bearings 114, springs 122, and spring caps 144 are the same as and are used in the same manner as that described above for the first embodiment. It should be noted that the inward extending notch 113 arranged on a first end of the lock out sleeve 112 may have any known shape from zero to 360° as long as that shape may mimic or be the opposite of the flange extending from an inner surface of the first ring 131 of the cylindrical housing 115. Hence, if the cylindrical housing 115 has a circumferential flange extending in a 270° arc the inward extending notch 113 of the lock out sleeve 112 would be approximately 90° or slightly less such that a gap 135 may be arranged between the first shoulder surfaces and the second shoulder surfaces, respectively. However, it is contemplated in the preferred embodiment to have the inward extending notch 113 of the lock out sleeve 112 to be slightly larger than 180° while the locking flange of the cylinder housing 115 to be 180° or slightly less than 180° thus allowing for a predetermined size gap 135 to be arranged therebetween when the pin tumbler cylinder lock 110 is in its locked or key operating positions. It should further be noted that the alternate embodiment also has independent divisional shear lines such as those described above for the first embodiment.

In operation, the alternate embodiment pin tumbler cylinder lock 110 of the present invention operates in the same manner as the embodiment described above in creating a virtually pick proof locking mechanism via the use of the lock out sleeve 112 in conjunction with the cylinder housing 115. The pin tumbler springs 112 and pin chambers 140 all operate in the same manner as those described above for the first embodiment. Generally, the only difference between embodiments may be that during an attempted picking of the alternate embodiment lock 110, the shoulders of the cylinder housing 115 and lock out sleeve 112 may engage with one another thus preventing the lock picker from accessing the middle four pin tumblers of the pin tumbler lock 110. When the lock 110 is placed back to its neutral or locked position, the pin tumblers may reset back to the proper position and the lock 110 may once again be in a locked state. Hence, the only way to open the lock 110 of the present invention, either the alternate embodiment or the original embodiment, is with a proper key. Therefore, the alternate embodiment lock 110 generally operates in the same manner as that described above for the first embodiment.

The present invention has been described in an illustrative manner. It is to be understood that the terminology which has been used is intended to be in the nature of words of description rather than that of limitation.

Many modifications and variations of the present invention are possible in light of the above teachings. Therefore, within the scope of the appended claims, the present invention may be practiced otherwise than as specifically described.

What is claimed is:

1. A pin tumbler cylinder lock, said lock comprising:

a cylinder housing having a bore;

a cylinder key plug arranged in said bore;

a cut out portion arranged in said cylinder housing, said cut out portion is arranged in a bottom middle section of said cylinder housing;

a flange extending from an outer surface of said cylinder housing, said flange having a plurality of pin chambers arranged therein;

a lock out sleeve arranged over only a middle section of said cylinder key plug and rotatably within said cut out portion, said lock out sleeve and said cylinder key plug rotates together in said cut out portion in a clockwise or counterclockwise direction only when a first and last pin tumbler of said plurality of pin tumblers have been picked, said lockout sleeve having a plurality of pin chambers with a smaller diameter than a diameter of said plurality of pin chambers of said flange; and a ball bearing arranged in a predetermined number of middle said pin chambers of said flange, said ball bearing having a diameter that is larger than said smaller diameter of said lockout sleeve pin chambers, said ball bearing cannot enter said lockout sleeve pin chambers.

2. The pin tumbler cylinder lock of claim 1 further comprising a first shear line arranged at a periphery of said lock out sleeve, said first shear line having friction free rotational resistance.

3. The pin tumbler cylinder lock of claim 1 further comprising a second shear line arranged at a periphery of said cylinder key plug.

4. The pin tumbler cylinder lock of claim 1 wherein said cylinder housing having a shoulder arranged within said cut out portion.

5. The pin tumbler cylinder lock of claim 4 wherein said lock out sleeve having a shoulder on an outer circumferential edge thereof, said lock out sleeve shoulder interacts and engages with said cylinder shoulder when the pin tumbler cylinder lock is in a lock out mode.

6. The pin tumbler cylinder lock of claim 1 further comprising a two piece pin tumbler arranged in each pin chamber.

7. The pin tumbler cylinder lock of claim 6 wherein middle pin chambers of said plurality of pin chambers having a larger diameter in said cylinder housing than end pin chambers of said plurality of pin chambers, said middle pin chambers allow zero rotational tension, said end pin chambers allow rotational tension.

8. The pin tumbler cylinder of claim 7 wherein said middle pin chambers having a lower section, said lower section having a serrated surface.

9. The pin tumbler cylinder lock of claim 8 wherein a top of said two piece pin tumblers in said middle pin chambers having a serrated outer surface on a top portion thereof.

10. The pin tumbler cylinder lock of claim 1 further comprising bottom pin tumblers having different heights.

11. The pin tumbler cylinder lock of claim 10 further comprising top pin tumblers having different heights, said bottom pin tumbler and said top pin tumbler having same total height as other said top and bottom pin tumblers in predetermined other pin chambers.

12. The pin tumbler cylinder lock of claim 1 wherein said cylinder key plug having a paracentric key way.

13. The pin tumbler cylinder lock of claim 1 wherein said lock out sleeve rotates in said cut out portion and a lock out sleeve shoulder contacts a cylinder housing shoulder when lock picking is attempted to create a lock out mode, the pin tumbler lock is reset from said lock out mode by reversing rotation of said key plug to a locked position.

14. A cylinder lock, said lock comprising:

a cylinder housing having a bore;

a cylinder key plug arranged in said bore;

a cut out portion arranged in a bottom middle section of said cylinder housing;

a plurality of pin chambers arranged in a flange of said cylinder housing and a lock out sleeve arranged over only a middle section of said cylinder key plug and within said cut out portion, said lock out sleeve and said cylinder key plug rotates together in said cut out portion in a clockwise or counterclockwise direction only when a first and last pin tumbler of said plurality of pin tumblers have been picked, said lockout sleeve having a plurality of pin chambers with a smaller diameter than a diameter of said plurality of pin chambers of said flange; and a ball bearing arranged in a predetermined number of middle said pin chambers of said flange, said ball bearing having a diameter that is larger than said smaller diameter of said lockout sleeve pin chambers, said ball bearing cannot enter said lockout sleeve pin chambers.

15. The cylinder lock of claim 14 further comprising a first shoulder arranged on an edge of said cut out portion of said cylinder housing and a second shoulder arranged on an outer edge of said lock out sleeve, said first and second shoulder only interact and interengage with one another when the cylinder lock is in a reversible lock out mode during a lock picking attempt.

16. The cylinder lock of claim 14 wherein said plurality of pin chambers having six total said pin chambers, a middle four of said plurality of pin chambers having a diameter greater than a first and last pin chamber diameters, said middle four pin chambers arranged between said top surface of said cylinder housing and said cavity, said first and last pin chambers arranged between said top surface of said cylinder housing and said single bore, said middle four pin chambers allow zero rotational tension, said first and last pin chambers allow rotational tension.

17. The cylinder lock of claim 14 further comprising a two piece tumbler arranged in each said pin chamber, a spring arranged in said pin chamber, said spring is arranged between a top tumbler and a spring cap of said cylinder housing of end pin chambers, said spring is arranged between a ball bearing and said spring cap of said cylinder housing of middle pin chambers, said middle pin chambers having a serrated lower section and a top tumbler having a serrated outer surface on a portion thereof.

18. The cylinder lock of claim 14 wherein said cylinder key plug having a paracentric key way.

* * * * *